US007958882B1

(12) United States Patent
Sgourides

(10) Patent No.: US 7,958,882 B1
(45) Date of Patent: Jun. 14, 2011

(54) COLLAPSIBLE BARBEQUE SYSTEM

(76) Inventor: John Sgourides, Palm Harbor, FL (US)

( * ) Notice: Subject to any disclaimer, the term of this patent is extended or adjusted under 35 U.S.C. 154(b) by 334 days.

(21) Appl. No.: 12/218,390

(22) Filed: Jul. 15, 2008

Related U.S. Application Data

(60) Provisional application No. 60/959,713, filed on Jul. 16, 2007.

(51) Int. Cl.
*F24C 1/16* (2006.01)

(52) U.S. Cl. ..... 126/9 R; 126/9 B; 126/25 R; 126/29; 126/38; 220/4.28; 220/287; 220/781

(58) Field of Classification Search ..... 126/25 R, 126/29, 38, 9 B, 9 R; 220/4.28, 287, 781
See application file for complete search history.

(56) References Cited

U.S. PATENT DOCUMENTS

| | | | | |
|---|---|---|---|---|
| 1,404,314 | A * | 1/1922 | Olsen | 126/38 |
| 3,556,076 | A * | 1/1971 | Stewart | 126/9 R |
| 4,210,118 | A * | 7/1980 | Davis et al. | 126/25 R |
| 4,273,395 | A * | 6/1981 | Martinez et al. | 312/205 |
| 4,471,749 | A * | 9/1984 | Galdes | 126/9 R |
| 4,492,215 | A * | 1/1985 | DiGianvittorio | 126/9 R |
| 4,616,624 | A * | 10/1986 | Parker | 126/9 R |
| 5,970,971 | A * | 10/1999 | Wu | 126/38 |
| 6,131,505 | A * | 10/2000 | Lin | 99/340 |
| 6,199,548 | B1 * | 3/2001 | Hsu | 126/194 |
| 6,205,912 | B1 * | 3/2001 | Chiu | 99/339 |
| 6,237,472 | B1 * | 5/2001 | Gates | 99/446 |
| 6,257,229 | B1 * | 7/2001 | Stewart et al. | 126/276 |
| 6,260,729 | B1 * | 7/2001 | Mitchell et al. | 220/287 |
| 6,422,230 | B1 * | 7/2002 | Stewart et al. | 126/25 R |
| 6,437,291 | B1 * | 8/2002 | Hopponen | 219/395 |
| 6,439,222 | B1 * | 8/2002 | Dixon et al. | 126/41 R |
| 6,546,846 | B1 * | 4/2003 | Lin | 99/342 |
| 6,681,759 | B2 * | 1/2004 | Bentulan | 126/25 R |
| 6,910,475 | B2 * | 6/2005 | Zelek et al. | 126/25 R |
| 6,951,213 | B2 * | 10/2005 | Coleman et al. | 126/38 |
| 6,981,497 | B2 * | 1/2006 | DeMars | 126/38 |
| 7,342,202 | B2 * | 3/2008 | Bachinski et al. | 219/386 |
| 7,681,567 | B2 * | 3/2010 | Chung | 126/25 R |
| 2002/0020405 | A1 * | 2/2002 | Coleman et al. | 126/41 R |
| 2002/0069865 | A1 * | 6/2002 | Stewart et al. | 126/9 R |
| 2002/0112717 | A1 * | 8/2002 | Bentulan | 126/25 R |
| 2003/0145882 | A1 * | 8/2003 | Sanna | 135/128 |
| 2004/0112361 | A1 * | 6/2004 | Zelek et al. | 126/25 R |
| 2005/0252504 | A1 * | 11/2005 | Cabrera et al. | 126/50 |
| 2006/0054395 | A1 * | 3/2006 | Kovacic | 182/141 |
| 2006/0130825 | A1 * | 6/2006 | Yeh | 126/25 R |
| 2006/0266754 | A1 * | 11/2006 | Carmona | 220/666 |
| 2007/0290486 | A1 * | 12/2007 | Chung | 280/645 |

* cited by examiner

*Primary Examiner* — Kenneth B Rinehart
*Assistant Examiner* — Jorge Pereiro

(57) ABSTRACT

A tub in a generally rectilinear configuration has a rear face, a front face and side faces. The tub has a closed bottom and an open top. The tub contains heating elements with controls in the front face. The controls are adapted to be manipulated by a user during operation and use. A lid in a generally rectilinear configuration has a posterior element and an anterior element. The posterior element has a rear face, an open front and side faces. The posterior element has an open bottom and a closed top. The anterior element has a front face, an open rear and side faces. The posterior element has an open bottom and a closed top. The rear of the anterior element is adapted to slidably couple with respect to the front of the posterior element. In this manner movement is provided between an expanded and contracted orientation.

4 Claims, 21 Drawing Sheets

COLLAPSIBLE BARBEQUE SYSTEM

RELATED APPLICATION

The present Non-Provisional U.S. Patent Application is based upon U.S. Provisional Application No. 60/959,713 filed Jul. 16, 2007, the subject matter of which is incorporated herein by reference.

BACKGROUND OF THE INVENTION

Field of the Invention

The present invention relates to a collapsible barbeque system and more particularly pertains to cooking on a grill with a system which is reconfigurable between an expanded operative orientation adapted for use and contracted inoperative orientation adapted for storage, all in a safe, convenient and economic manner.

SUMMARY OF THE INVENTION

The popularity of gas barbecue grills has increased tremendously over the recent decades. Most recently, a trend has formed for stainless steel products, especially with regards to backyard, gas barbecue grills, and the very latest trend has shown an ever increasing demand for portability and convenience among many products, but especially when it comes to barbecue grills. These trends have opened a need in the market which has yet to be successfully filled. Currently there does not appear to be any portable barbecue device offered that can compare closely to a beautiful, backyard, stainless steel gas grill. Likewise, there does appear to exist, in the market, a beautiful, high cooking-capacity, free-standing, stainless steel, gas barbecue grill that is in any reasonable or practical way portable.

Accordingly, to fill this need, a product must be introduced into the market that can adequately make up for the respective shortcomings of both the typical, backyard, gas barbecue grill as well as the standard, portable, barbecue grill. Such an apparatus should be fueled by gas, such as propane, have a large cooking surface, be capable of outputting high temperature ranges, be constructed of a durable, aesthetically-pleasing material, such as stainless steel, provide added conveniences, such as side shelves and electric igniters, and all at once be handily portable. The present invention successfully fills these needs and provides advantages that go beyond them.

In view of the disadvantages inherent in the known types of barbeque systems of known designs and configurations now present in the prior art, the present invention provides an improved collapsible barbeque system. As such, the general purpose of the present invention, which will be described subsequently in greater detail, is to provide a new and improved collapsible barbeque system and method which has all the advantages of the prior art and none of the disadvantages.

The present invention, in summary, relates to a barbecue cooking apparatus. More specifically, it relates to a collapsible, portable gas barbecue grill apparatus which can be easily transported or stored away. When fully expanded and set up for use, the barbecue apparatus much more closely resembles a typical backyard barbecue grill than it does a portable barbecue grill. It is the intent behind the invention to provide an aesthetically pleasing device which at first does not appear to be intended for portability, however, can be easily and quickly, with very minimal effort, collapsed into a very portable form.

The barbecue apparatus consists of five major elements which fit together to form a full assembly of the invention. The lid of the barbecue apparatus consists of two elements, an anterior and a posterior, which fit together to form a lid assembly. This lid assembly sits atop, and is attached to, a lower, main cooking element, which contains all of the heat producing components necessary for barbecue grilling. The lid assembly bears the capability of expanding in overall size so as to fit within it the lower, main cooking element upon which it is attached. As the anterior element of the lid is pulled forward and away from the posterior element, the lid assembly collapses itself completely around the lower, main cooking element of the apparatus and all of its components. Mechanisms on the underside of the main cooking element lock this collapsed assembly together.

The assembly of the anterior element, posterior element, and main cooking element sit atop the fourth element, a removable stand which has two large wheels and two smaller castors which swivel. This stand is capable being easily collapsed into folded form. When the stand is in its fully expanded or unfolded form, a bottom mount allows for the placement of a gas fuel tank which is then secured in place by another mount towards the top of the stand. The same mechanisms which lock the lid assembly down around the cooking element are also utilized to lock the cooking element onto the stand. When the stand is collapsed into its folded form, it doubles as a cart, similar in form to that of a hand truck dolly. In this folded form the assembly of the anterior element, posterior element, and main cooking element fit onto a hitch which is attached to the cart. This keeps the assembly in place while it is wheeled off.

A fifth element of the barbecue apparatus consists of a foldable shelf which simply drops into place over either the left or right side of the main cooking element. One or two of these shelves may be used or they may be left off completely and the barbecue apparatus will still maintain full cooking capabilities. Overall, the entire barbecue cooking apparatus employs the full cooking capabilities of a standard, three burner, electrically ignited, gas barbecue grill. It is able to reach comparably high temperature ranges and has a comparably large cooking surface. In its expanded form the barbecue apparatus appears as a standard, free-standing, home barbecue grill, and when collapsed into portable form, it is lightweight enough so that it may be carried by the average adult.

More specifically, the present invention comprises a collapsible barbeque system. First provided is a tub. The tub is in a rectilinear configuration. The tub has a rear face. The tub has a front face. The rear and front faces are separates by a depth. The tub has side faces. The side faces are provided between the front and rear faces. The side faces are separated by a width. The tub has a closed bottom. The tub has an open top. The bottom and top are separated by a height. The tub has heating elements. The tub has rotary controls. The rotary controls are provided in the front face. The rotary controls are adapted to be manipulated by a user during operation and use.

A lid is provided. The lid is in a rectilinear configuration. The lid has a posterior element. The lid has an anterior element. The posterior element has a rear face. The posterior element has an open front. The rear faces and open front are separated by a depth. The posterior element has side faces. The side faces are provided between the front and rear face. The side faces are separated by a width. The posterior element has an open bottom. The posterior element has a closed top.

The bottom and top are separated by a height. The anterior element has a front face. The anterior element has an open rear. The front face and open rear are separated by a depth. The anterior element has side faces. The side faces are provided between the rear and front face. The side faces are separated by a width. The posterior element has an open bottom. The posterior element has a closed top. The open bottom and closed top are separated by a height. The rear of the anterior element is adapted to slidably receive the front of the posterior element. In this manner movement is provided between an expanded and contracted orientation. When in the expanded orientation the anterior element only partially receives the posterior element. In this manner the lid is adapted to be lowered to receive and totally encompass the tub during storage. When in the collapsed orientation the posterior element is fully received by the anterior element. In this manner the lid is adapted to be resting atop the tub during use. A hinge is attached to the top of the rear face of the tub for pivotally coupling the lid to the tub.

Provided next is a removable stand. The stand has a central leg. The stand has side legs. Each leg has an upper end. The upper end is adapted to couple to the lower face of the tub and a lower end. The stand has a lower support. The lower support has wheels. The lower support has casters. The casters are coupled to the lower ends of the legs. The legs have pivot pins. The pivot pins couple the legs at central extents intermediate the upper and lower ends. The legs are pivotable between a folded orientation and an unfolded orientation. In the folded orientation the lower support is adjacent to the tub and adapted for storage. In the unfolded orientation the lower support is spaced from the tub and adapted for use.

Further provided is an upper locking sub-assembly includes a base plate attached beneath the tub with a downwardly extending post. An upper pan has an upwardly extending sleeve receiving the post. A toggle arm has a central bearing surface and lateral apertures adapted to oscillate on the sleeve. A lower pan slidably receives the upper pan with lateral supports attached to the base plate. A handle is adapted to reciprocate the upper pan to oscillate the toggle arm. A lock rod has a near end coupled to an aperture in the toggle arm and a free end movable into an aperture in the lid. The lock rod is adapted to move between a retracted unlocking orientation and an extended locking orientation coupling the lid to the tub.

A lower locking sub-assembly includes a cross bar with a centrally positioned upwardly extending pivot pin extending upwardly through the central leg of the stand. The cross bar is located beneath the central leg with downwardly extending fingers. The pivot pin has a washer and a handle above the central leg. Locking bars have apertured interior ends receiving the fingers. The locking bars have free ends movable into apertures in the side legs to lock the legs in a collapsed orientation.

Provided last is a plurality of shelves. Each shelf has a horizontal section below. The horizontal section receives cooking-related objects. Each shelf has a hook shaped end above. In this manner each shelf may be removably positioned over a side edge of the tub. Each shelf has a vertical section. The vertical section couples the horizontal section and the hook shaped end.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible barbeque system which has all of the advantages of the prior art barbeque systems of known designs and configurations and none of the disadvantages.

It is another object of the present invention to provide a new and improved collapsible barbeque system which may be easily and efficiently manufactured and marketed.

It is further object of the present invention to provide a new and improved collapsible barbeque system which is of durable and reliable constructions.

An even further object of the present invention is to provide a new and improved collapsible barbeque system which is susceptible of a low cost of manufacture with regard to both materials and labor, and which accordingly is then susceptible of low prices of sale to the consuming public, thereby making such collapsible barbeque system economically available to the buying public.

Even still another object of the present invention is to provide a collapsible barbeque system for cooking on a grill with a system which is reconfigurable between an expanded operative orientation adapted for use and contracted inoperative orientation adapted for storage, all in a safe, convenient and economic manner.

Lastly, it is an object of the present invention to provide a new and improved collapsible barbeque system. A tub in a generally rectilinear configuration has a rear face, a front face and side faces. The tub has a closed bottom and an open top. The tub contains heating elements with controls in the front face. The controls are adapted to be manipulated by a user during operation and use. A lid in a generally rectilinear configuration has a posterior element and an anterior element. The posterior element has a rear face, an open front and side faces. The posterior element has an open bottom and a closed top. The anterior element has a front face, an open rear and side faces. The posterior element has an open bottom and a closed top. The rear of the anterior element is adapted to slidably couple with respect to the front of the posterior element. In this manner movement is provided between an expanded and contracted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1-A is a perspective view of the invention in-fully-expanded form.

FIG. 1-B is a partially-exploded perspective view of the main elements of the invention separated from one another but prior to being set into collapsed and folded forms.

FIG. 1-C is a partially-exploded perspective view of the main elements of the invention after they have been set into collapsed and folded forms.

FIG. 1-D is a partially-exploded perspective view of the main elements of the invention as they fit together after being set into collapsed and folded forms.

FIG. 2-A is a perspective view of three elements of the invention showing the first step of the procedure for collapsing these said elements.

FIG. 2-B is a perspective view of three elements of the invention showing the second step of the procedure for collapsing these said elements.

FIG. 2-C is a perspective view of three elements of the invention showing the fully collapsed form of these said elements.

The same reference numerals refer to the same parts throughout the various Figures.

DESCRIPTION OF THE PREFERRED EMBODIMENT

Figure 1:
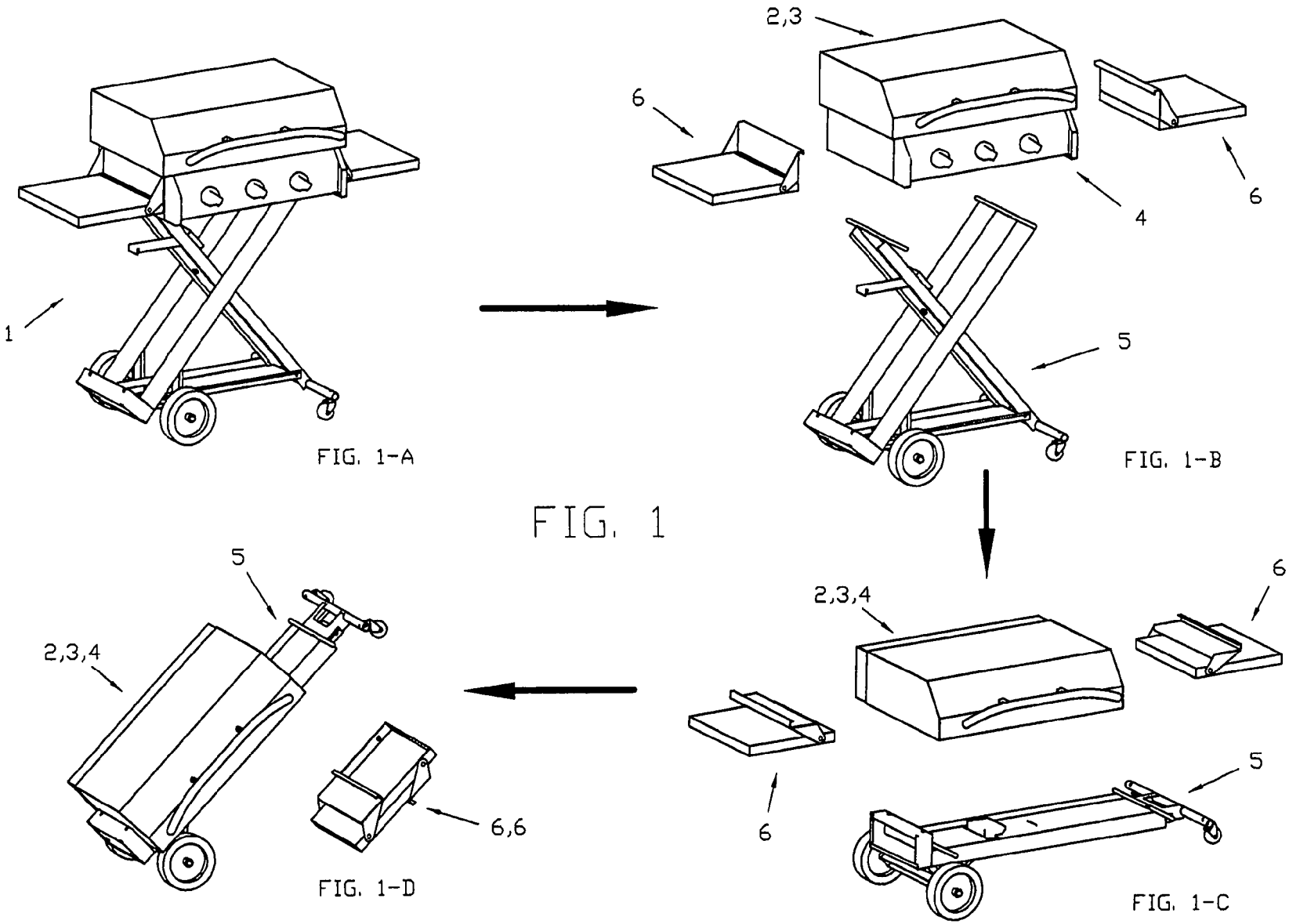
FIG. 1 presents four perspective views which illustrate the process by which the invention changes from expanded form to collapsed form. Within FIG. 1.

With reference now to the drawings, and in particular to FIG. 1 thereof, the preferred embodiment of the new and improved collapsible barbeque system embodying the principles and concepts of the present invention will be described.

As shown in FIG. 1 of the accompanying drawings, FIG. 1-A depicts a fully expanded form of the barbecue apparatus. This is the form in which it is to be used for cooking and this form will generally be referred to by the reference number 1. The barbecue apparatus 1 is comprised of several elements which include the anterior lid 2, posterior lid 3, cooking tub 4, cart-stand 5, and a side shelf 6 shown on both the left and right sides of the cooking tub 4. All components that make up these elements, unless otherwise specified, are typically comprised of metal such as steel, aluminum, brass, sheet metal, or the like.

Posterior lid 3 is not visible in FIG. 1-A or 1-B, however the rear-most portion of posterior lid 3 is visible in FIGS. 1-C and 1-D. Throughout this description and in the accompanying drawings each side shelf will be referred to by the reference number 6. Both the left side shelf 6 and right side shelf 6 are identical in design and differ only in that one is rotated with respect to the other by 180 degrees about a vertical axis. As depicted in FIG. 1-B, the left side shelf 6, right side shelf 6, and cart-stand 5 separate from the cooking tub 4.

Figure 2:
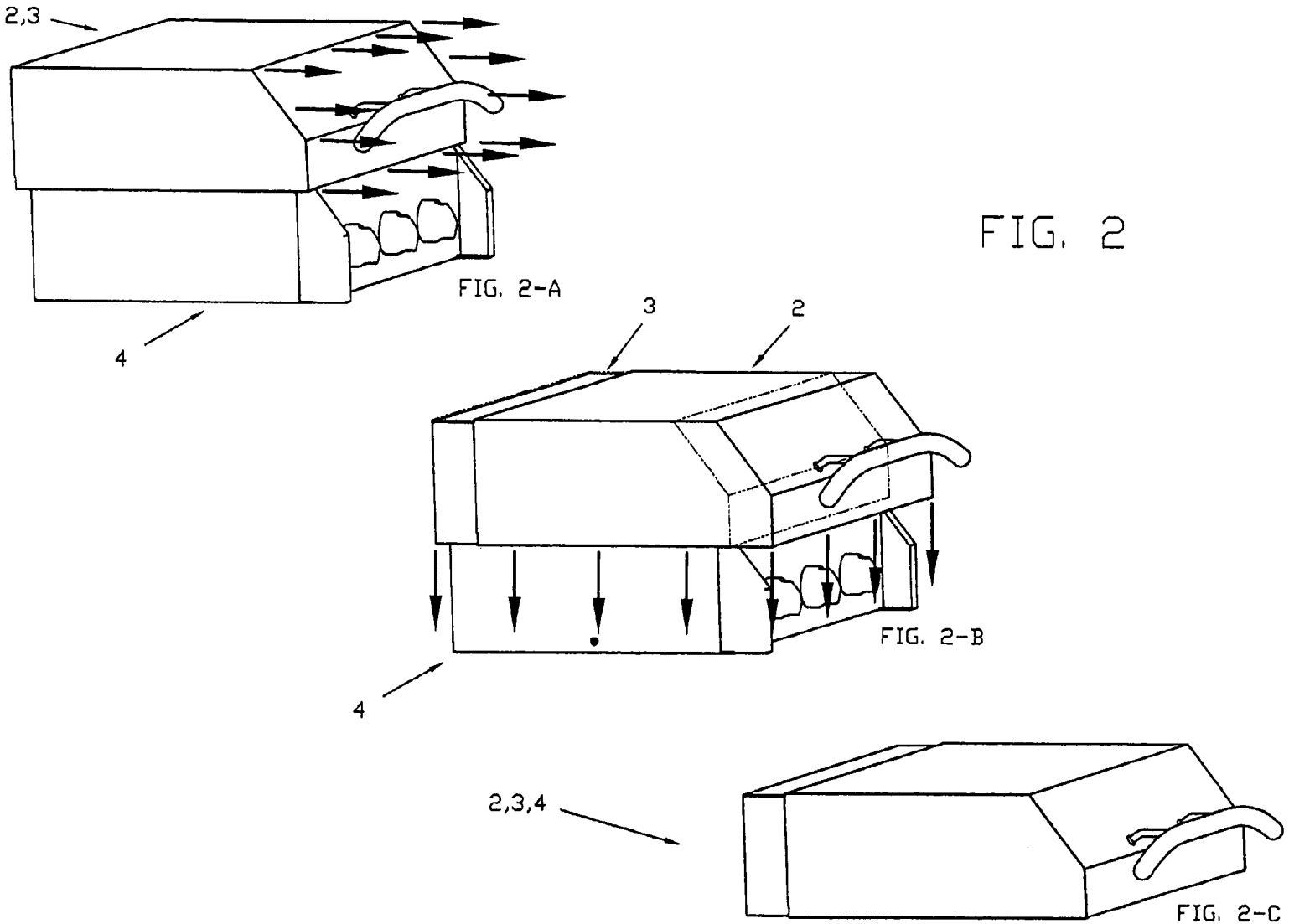
FIG. 2 presents three perspective views which illustrate the process by which two upper elements of the invention collapse around a lower element of the invention. Within FIG. 2.

The cooking tub 4 collapses into the assembly formed by anterior lid 2 and posterior lid 3 as shown in FIG. 2 wherein is depicted the method by which this is carried out. By this method, the anterior lid 2 is pulled a limited distance away from the posterior lid 3 as indicated by the arrows in FIG. 2-A. The rear-most part of the posterior lid 3 becomes visible in FIG. 2-B. As the anterior lid 2 and the posterior lid 3 are pulled apart past a given point, they are lowered around the cooking tub 4 with the assistance of gravity, as indicated by the arrows in FIG. 2-B, and form the collapsed image depicted in FIG. 2-C.

Figure 5:
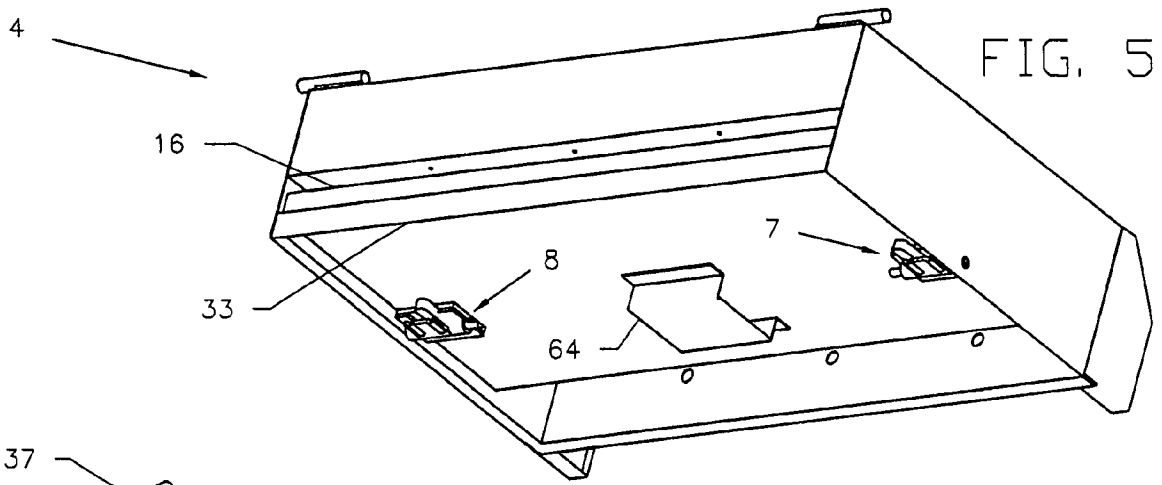
FIG. 5 is a perspective view from a bottom angle of one element of the invention.
Figure 19:
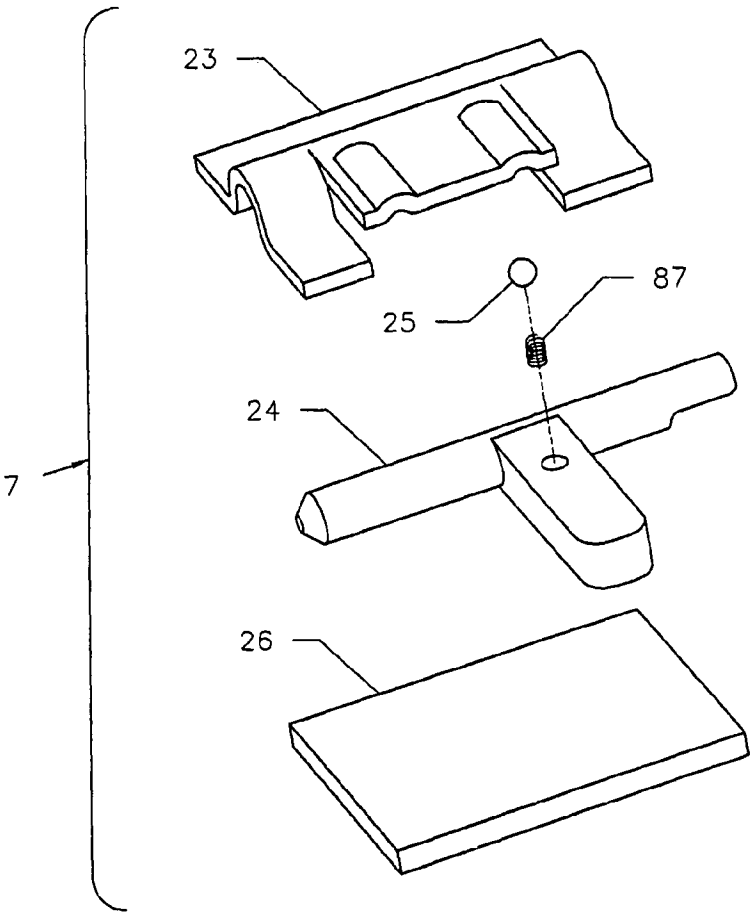
FIG. 19 is an exploded perspective view of one element of the invention.
Figure 17:
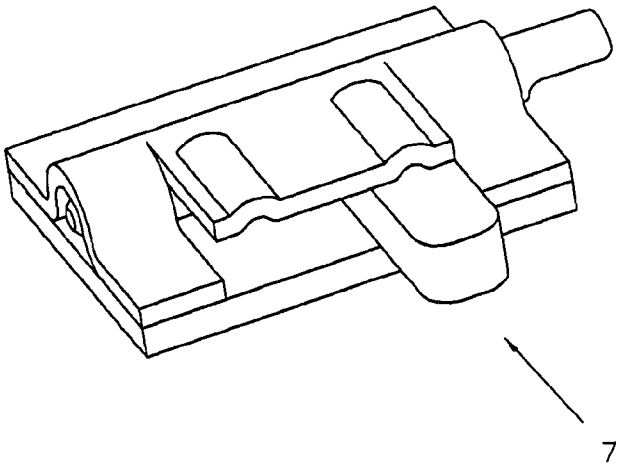
FIG. 17 is a perspective view from a top angle of one element of the invention.
Figure 18:
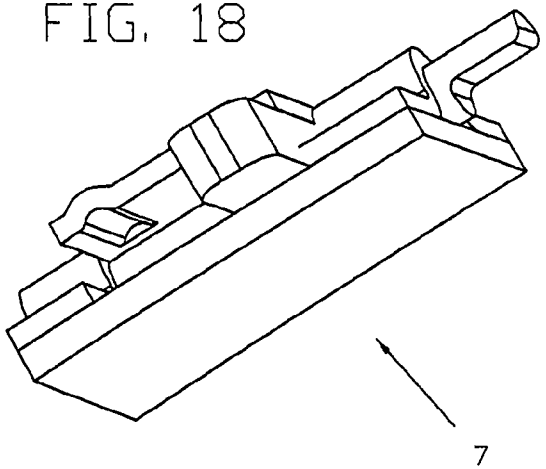
FIG. 18 is a perspective view from a bottom angle of one element of the invention.

Attached underneath cooking tub 4 are left lid-lock 7 and right lid-lock 8 which are manually engaged to hold cooking tub 4 in place. FIG. 5 shows the locations of left lid-lock 7 and right lid-lock 8 with respect to cooking tub 4. FIG. 17-19 illustrate the design of left lid-lock 7 which is basically a minor image of right lid-lock 8. All features and functions herein described for left lid-lock 7 are similarly applicable to right lid-lock 8. Left lid-lock pin 24 is machined to form a half-cylindrical shape on one side and a tapered end on the opposite side of its rod length. In FIG. 17-19 the tapered end is depicted to towards the left and the half-cylindrical end towards the right. Left lid-lock pin 24, lock pin ball 25 and lock ball pressure spring 87 are housed between left lid-lock pin guide 23 and left lid-lock pin base plate 26. Left lid-lock pin guide 23 and left lid-lock pin base plate 26 are attached by any preferred method of welding as known in the art to form a housing. As left lid-lock pin 24 slides laterally within this formed housing, the lock pin ball 25 is under constant pressure by lock ball pressure spring 87 against left lid-lock pin guide 23. At either, furthermost, end of the sliding motion of the left lid-lock pin 24, the lock pin ball 25 engages into the grooves in left lid-lock pin guide 23 to hold it from sliding freely and prevent undesirable disengagement of the left lid-lock pin 24.

As shown in FIG. 5 the tapered ends of left lid-lock pin 7 and right lid-lock pin 8 are positioned outwardly toward, and aligned with holes in, left tub side 34 and right tub side 35 respectively. When anterior lid 2 is extended forward and down around cooking tub 4, holes in left pivot plate 69 and right pivot plate 70 line up with holes in left tub side 34 and right tub side 35 respectively. Left lid-lock pin 24 and right lid-lock pin 28 slide through holes in left tub side 34 and right tub side 35 respectively, then continue to slide into holes in left pivot plate 69 and right pivot plate 70 respectively to lock cooking tub 4 in place while it is collapsed into the extended assembly of anterior lid 2 and posterior lid 3.

With reference now to FIGS. 1-B and 1-C, cart-stand 5 is designed so as to be easily folded from the upright, standing form shown in FIG. 1-B, here-on referred to as unfolded form, to the folded-down, dolly-like form shown in FIG. 1-C, here-on referred to as folded form. Cart mount hitch 63, depicted in FIGS. 7 and 13 and visible in FIG. 1-C, fits into cart mount receiver 64 which is located on the underside of cooking tub 4 as shown in FIG. 5. By this fitting of cart mount hitch 63 into cart mount receiver 64 the assembly consisting of anterior lid 2, posterior lid 3, and cooking tub 4 is secured in place onto folded cart-stand 5 so that it may be rolled away in a similar manner as with a typical hand-truck or hand-dolly. The manner of transformation of cart-stand 5 from unfolded form to folded form will later be described in more detail.

Figure 8:
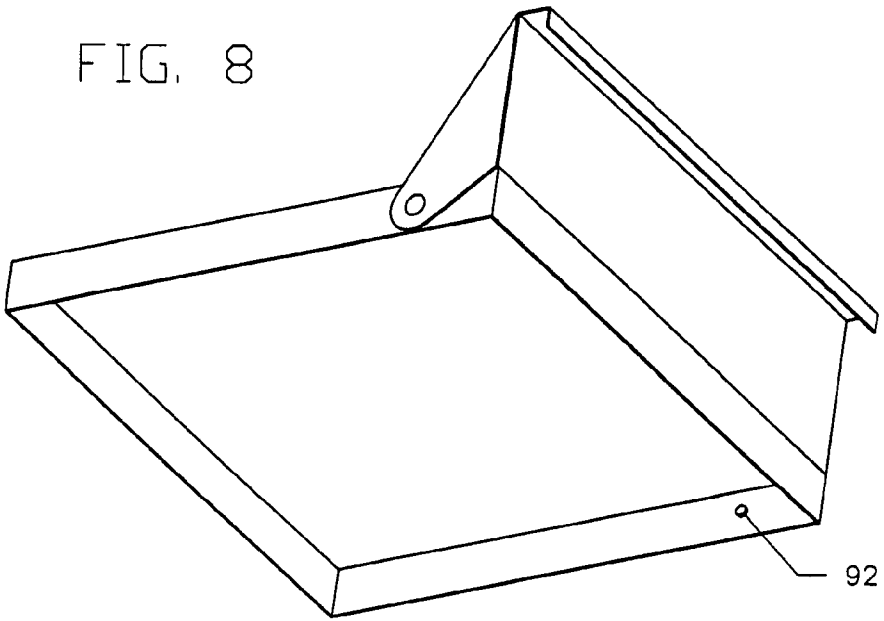
FIG. 8 is a perspective view from a bottom angle of one element of the invention.
Figure 9:
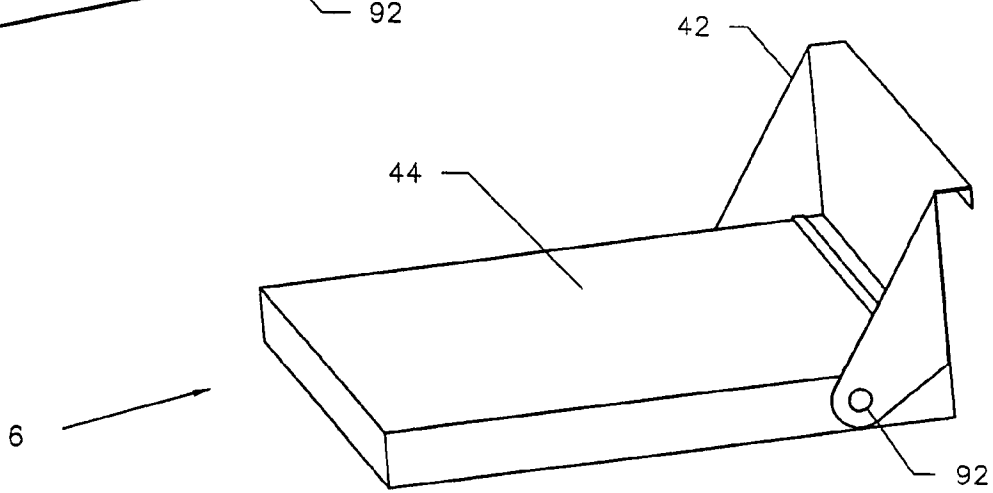
FIG. 9 is a perspective view from a top angle of one element of the invention.
Figure 12:
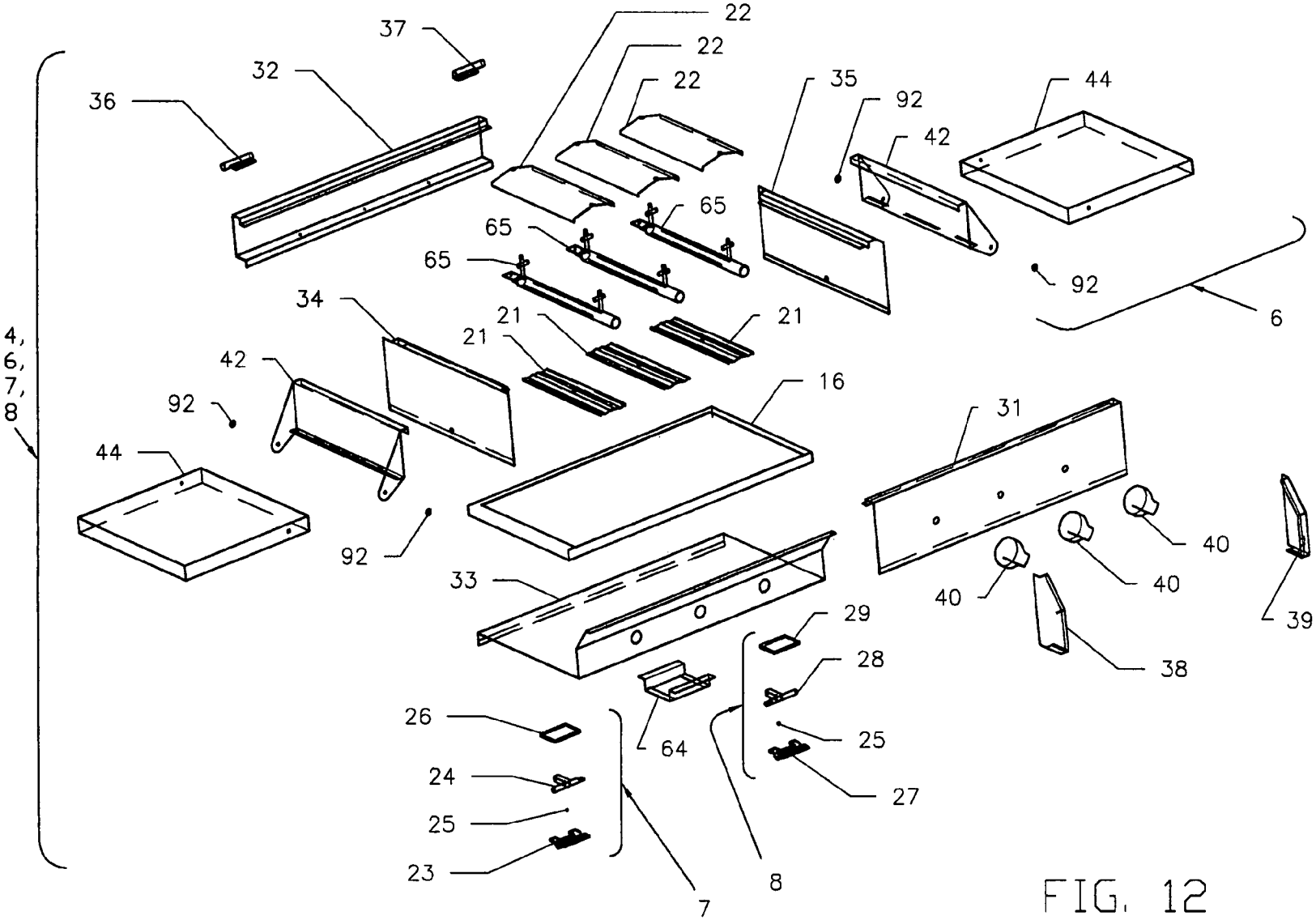
FIG. 12 is an exploded perspective view of the various component parts of three elements of the invention.

Side shelf 6, shown in FIGS. 1, 8, 9, and 12 though not necessary for the utilization of the barbecue apparatus for cooking purposes, serves its own desirable purpose, both aesthetically and practically, and has therefore been added to the drawings and description. One or two side shelves 6 may be used. Each attaches by simply placing shelf bracket 42 over the top of either left tub side 34 or right tub side 35. The top of shelf bracket 42 is shaped so that it fits snugly in place over left tub side 34 or right tub side 35. When removed, side shelf 6 may be made slightly more compact by folding shelf bracket 42 down above shelf 44 as shown in FIG. 1-C. Shelf rivets 92 are used to attach shelf bracket 42 to shelf 44 as depicted in FIGS. 8, 9, and 12. Shelf rivets 92 are typical rivets as known to the art.

For sake of space and since most of the components of the invention are attached in a similar manner, unless otherwise specified, when a component is joined or attached to another component by "a preferred method of welding typical to the art", this will here-on be referred to as "a typical weld" or "typically welded".

Figure 3:
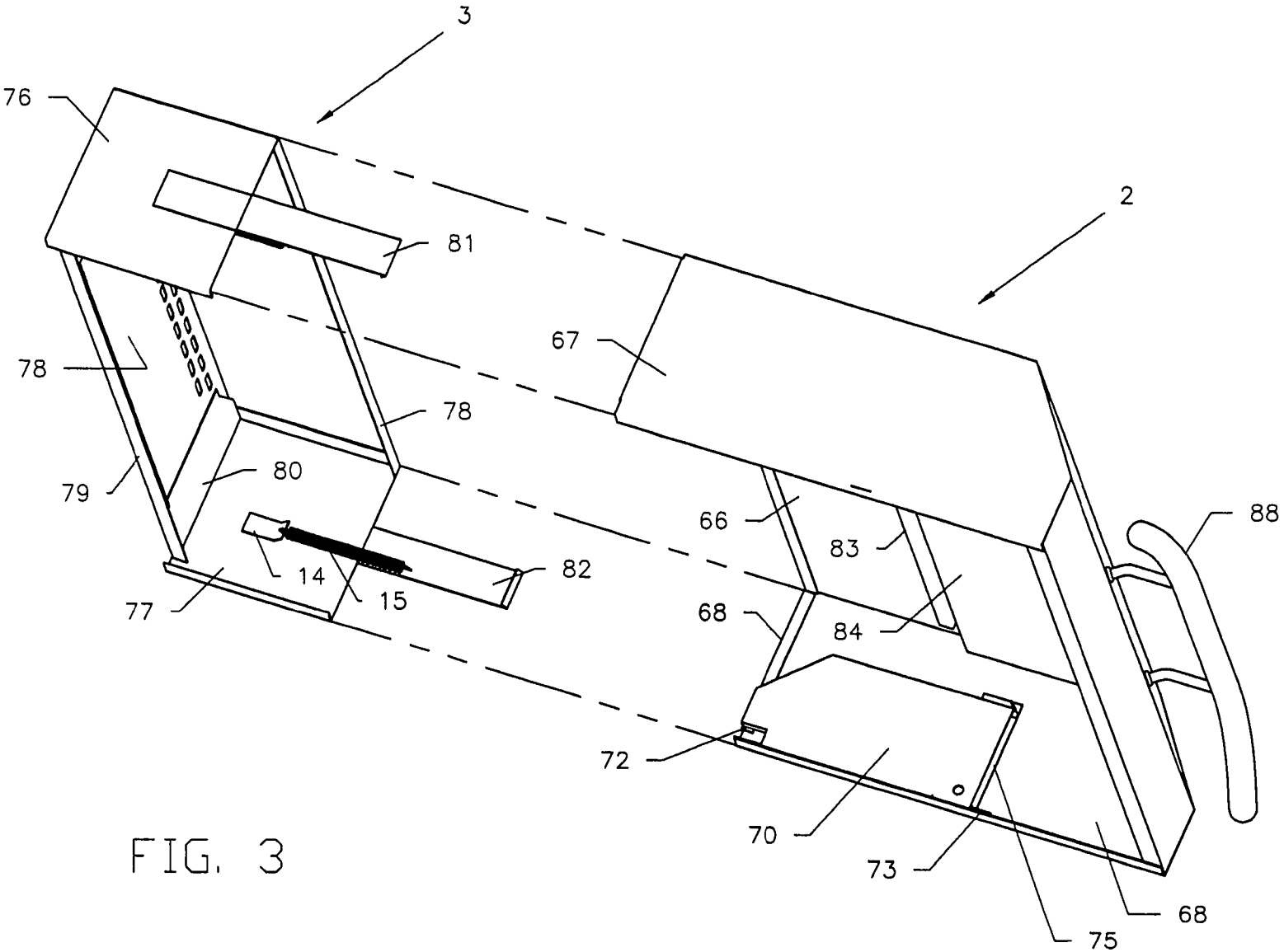
FIG. 3 is a perspective view of two elements of the invention with phantom lines shown to indicate the alignment of these two elements as they fit together to form an assembly.
Figure 10:
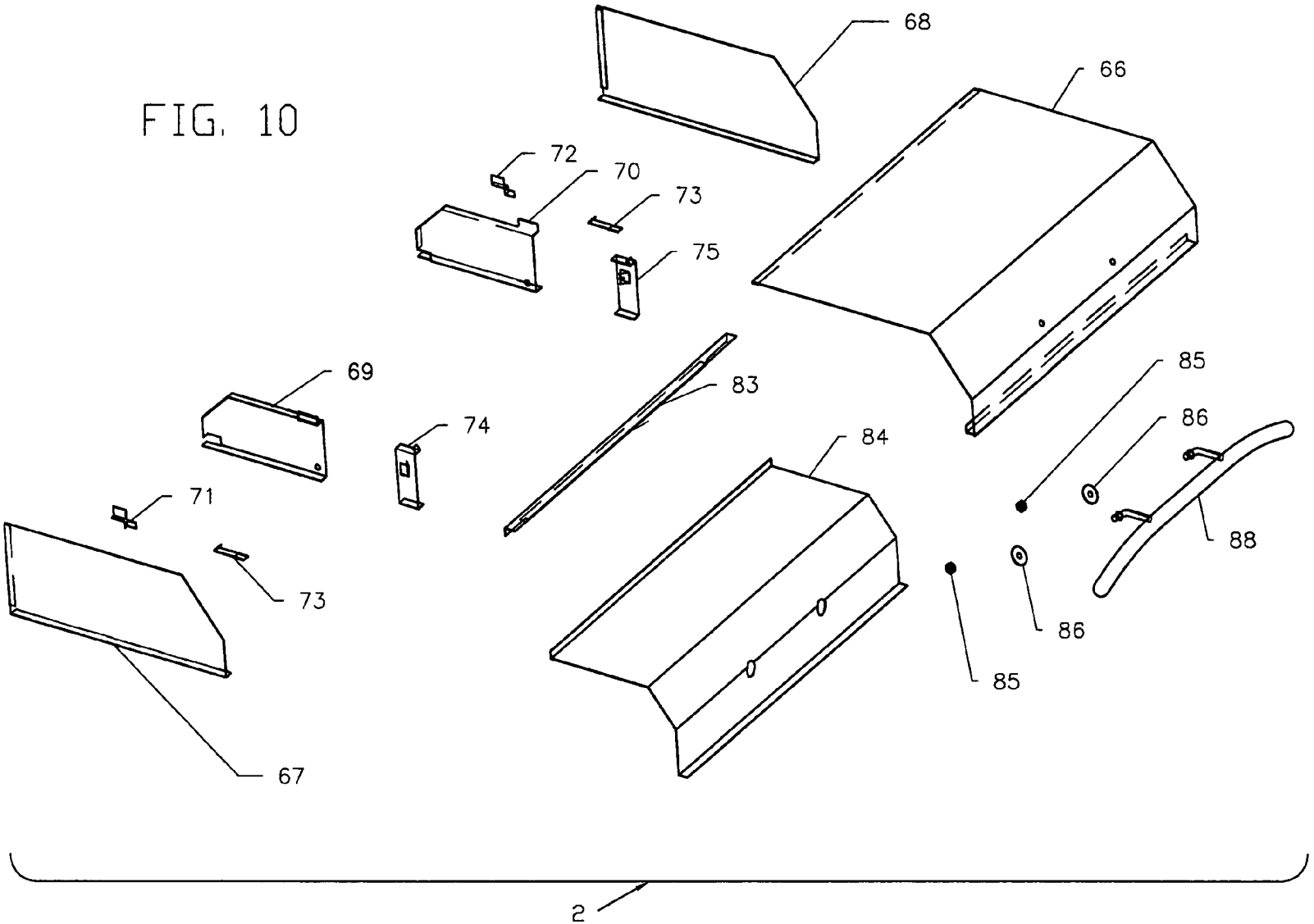
FIG. 10 is an exploded perspective view of the various component parts of one element of the invention.

With reference now to FIGS. 3 and 10, the anterior lid 2 is comprised several components. Left lid side 67 and right lid side 68 are attached to lid top 66 by a typical weld. Lid beam 83 is typically welded to the underside of lid top 66 in position shown in FIG. 3. Heat shield 84 is placed between lid beam 83 and the inner-front of lid top 66. As the components are depicted in FIG. 10, the 90 degree bend at the lower-right of heat shield 84 fits into the squared U-channel at the lower-right of lid top 66. To hold it in place, the upper-left 90 degree bend of heat shield 84 is attached to lid beam 83 by either small rivets, not shown, or by a typical weld. Though not shown in drawings, ribs may be added along face of heat shield 84 for strength and to prevent it from warping when heated.

As shown in FIG. 10, two fender washers, each referred to as handle washer 86, are placed on the inside of, and aligned with the holes in, lid top 66 and are to be typically welded in place. Permanently attaching them to the inside of lid top 66 will add structural support to prevent deformation of the front face of lid top 66, should handle 88 be hit with a blunt force from the outside, for example: by sliding around a pickup truck bed. Handle 88 consists of a curved metal tube with two metal rods welded equidistant from the midpoint on the lid-side of the tube. The rods are slightly bent so-as to enter the holes on the face of lid top 66 perpendicularly. A portion of the ends of each rod are threaded and a flange placed at the base of the thread. Each rod is positioned in its respective hole and held in place by handle nut 85.

Figure 14:
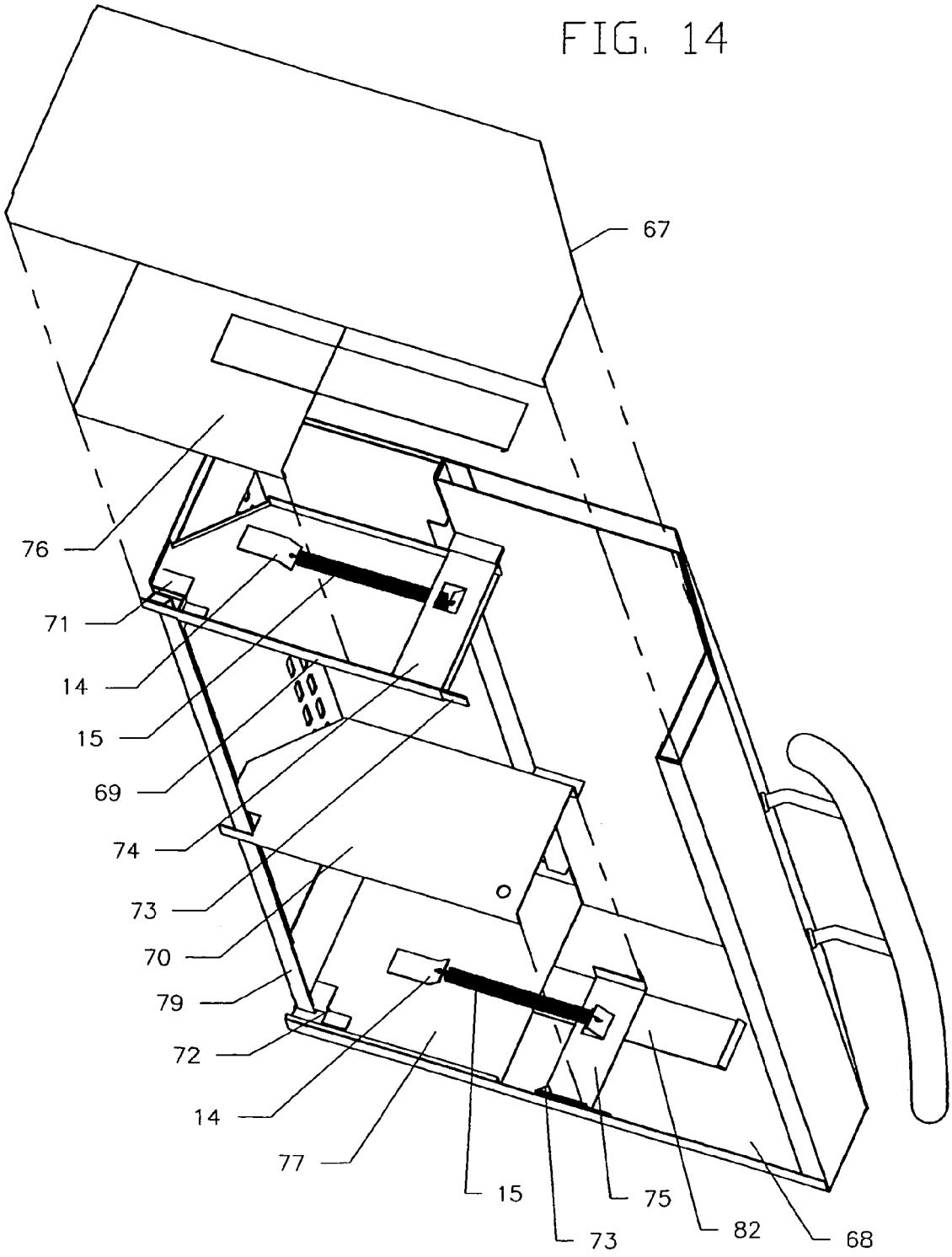
FIG. 14 is a partially-exploded perspective view of two elements of the invention with phantom lines shown to indicate the alignment of various components of the invention as they fit together.

With reference now to FIGS. 3, 10, and 14, left pivot plate 69, left pivot bearing 71, and left keeper bracket 74 are, respectively, mirror images of right pivot plate 70, right pivot bearing 72, and right keeper bracket 75. All features, functions, and descriptions of assembly herein described for left pivot plate 69, left pivot bearing 71, and left keeper bracket 74 are similarly applicable to right pivot plate 70, right pivot bearing 72, and right keeper bracket 75. For sake of avoiding redundancy only the description of right pivot plate 70, right pivot bearing 72, and right keeper bracket 75 will be detailed thoroughly, although, to assist in clarity, reference may be made to left pivot plate 69, left pivot bearing 71, and left keeper bracket 74 as depicted in FIG. 14.

Figure 21:
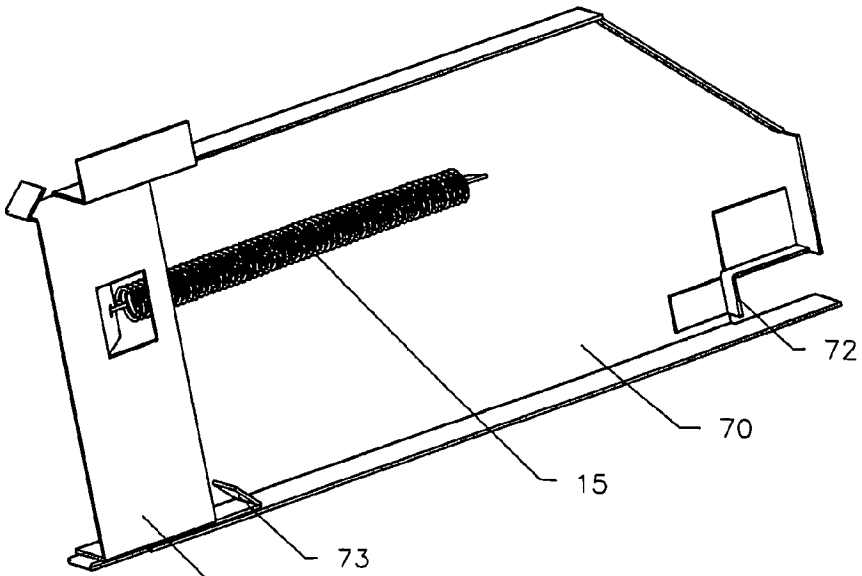
FIG. 21 is a perspective view of various component parts of the invention.

FIG. 21 shows the side of right pivot plate 70 that faces right lid side 68. Right pivot bearing 72 is attached to right pivot plate 70 by a typical weld in the position shown in FIG. 21. Keeper stop 73 is also attached to right pivot plate 70 by a typical weld in the position shown in FIG. 21. Right keeper bracket 75 is positioned loosely in the position shown in FIG. 21. This location is between right pivot plate 70 and right lid side 68 when they are assembled. Right keeper bracket 75 is intended to slide freely within this position. As the images of the components are portrayed in FIG. 21, right keeper bracket 75 has a folded tab at its top left which is angled towards the right. This tab is intended to come in contact with the top-left horizontal edge of right pivot plate 70 when right keeper bracket 75 is loaded by lid spring 15 to prevent it from traveling past that point. Keeper stop 73 has a similar folded tab which contacts the bottom of right keeper bracket 75 and also serves to limit its travel.

The assembly consisting of right pivot plate 70, right pivot bearing 72, and keeper stop 73 is attached to right lid side 68 at the position shown in FIG. 3 by a typical weld along the mating surfaces of these components. As the images of the components are portrayed in FIG. 10, these mating surfaces are: between the tab at the top-right of right pivot plate 70 and the parallel face of right lid side 68 and along the bottom of right pivot plate 70 and the parallel edge at the bottom of right lid side 68.

Figure 11:
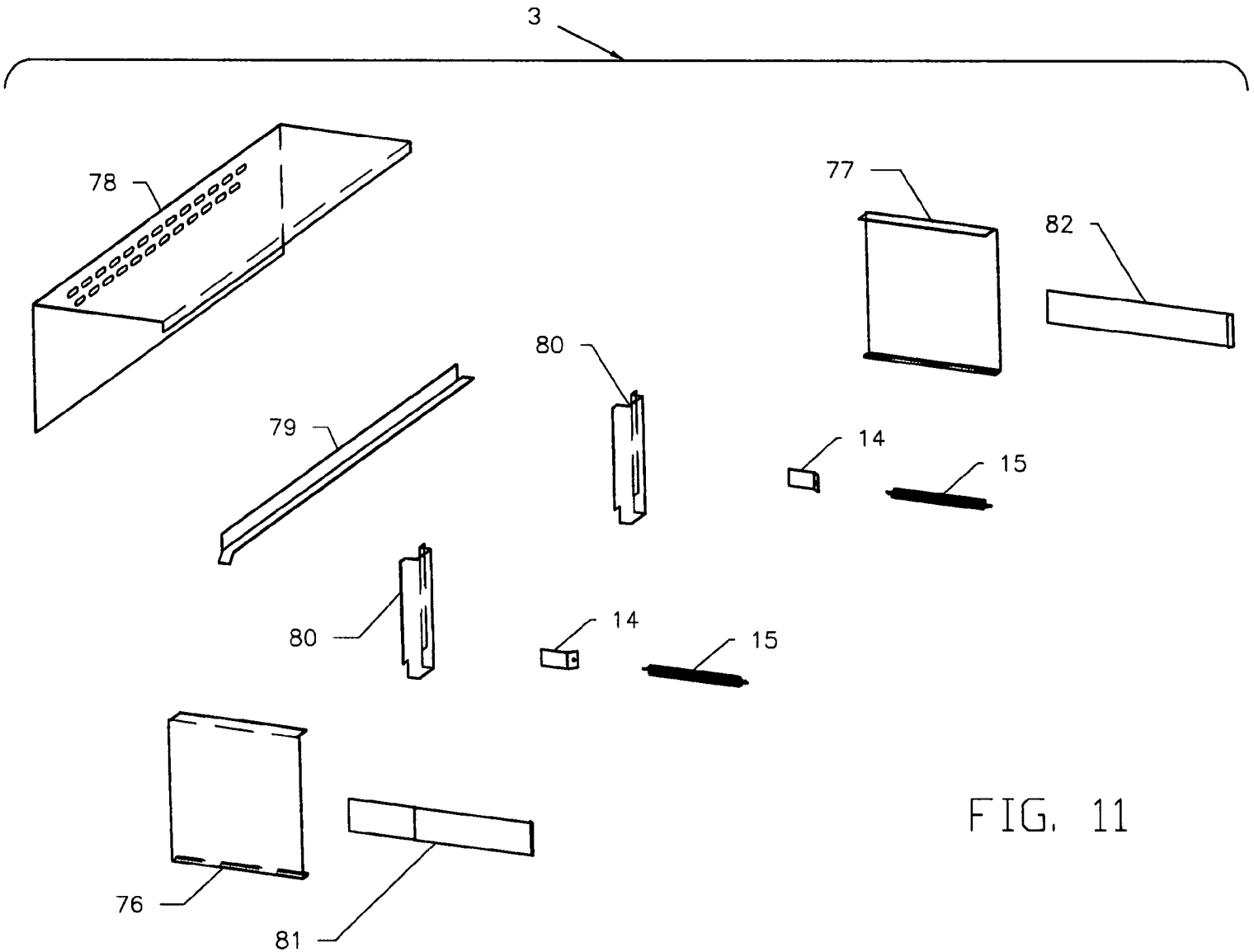
FIG. 11 is an exploded perspective view of the various component parts of one element of the invention.

Posterior lid 3 is designed to fit inside of anterior lid 2. With reference now to FIGS. 3, 11, and 14, posterior lid 3 is assembled in the following manner. Left lid insert side 76 and right lid insert side 77 are typically welded to lid insert top 78 to form the arrangement shown in FIG. 3. Left insert stop arm 81 is typically welded to the outside face of left lid insert side 76 and right insert stop aim 82 is typically welded to the outside face of right lid insert side 77 at positions respectively depicted in FIG. 3.

One lid spring bracket 14 is typically welded to the inside face of left lid insert side 76 and one lid spring bracket 14 is typically welded to the inside face of right lid insert side 77. The relative position of lid spring bracket 14 is depicted in FIGS. 3 and 14. One support bracket 80 is attached by a typical weld towards the left of the inside face of lid insert top 78 and one support bracket 80 is also attached towards the right of the inside face of lid insert top 78. Each is placed vertically, as shown oriented in FIGS. 3 and 14. For clearance purposes, each must be placed at an adequate distance from left lid insert side 76 and right lid insert side 77 respectively so as to allow enough clearance for left and right pivot plates 69 and 70 to pass between so they may come into contact with the inside face of lid insert top 78 when posterior lid 3 is fully inserted into anterior lid 2. Fold tab ridge 79 is attached at position shown in FIGS. 3 and 14. One end of lid spring 15 is inserted into hole in lid spring bracket 14 on both the right and left sides of posterior lid 3.

The following is a description of the position of the various components of posterior lid 3 with respect to various components of anterior lid 2. The positions and functions of the left side components are basically a mirror image of, and are similar to, those of the right side components.

For sake of avoiding virtually repeating the descriptions, only the right side components will be described in detail. All details relative to this description are to be understood as being similarly applicable to both the right side components as well as the left side components. The assembly consisting of posterior lid 3 and anterior lid 2 will be referred to as lid assembly 2, 3.

With reference to FIG. 14, when posterior lid 3 is inserted into anterior lid 2, right insert stop arm 82, right lid insert side 77, lid spring bracket 14, and lid spring 15 pass between right pivot plate 70 and right lid side 68. After posterior lid 3 is inserted into anterior lid 2, right keeper bracket 75 is inserted between right pivot plate 70 and right insert stop arm 82 and attached to the loose end of lid spring 15. Lid spring 15 serves two major functions. First, it holds right keeper bracket 75 in place behind right pivot plate 70, and second it applies a force sufficient to support at least half of the total weight of posterior lid 3 and keep it fully inserted into anterior lid 2 when the lid assembly 2, 3 of the barbecue apparatus 1 is lifted open during normal use. Lid spring 15 should be comprised of a material that will retain its elasticity when repeatedly heated to the high temperatures normally produced during cooking.

Figure 20:
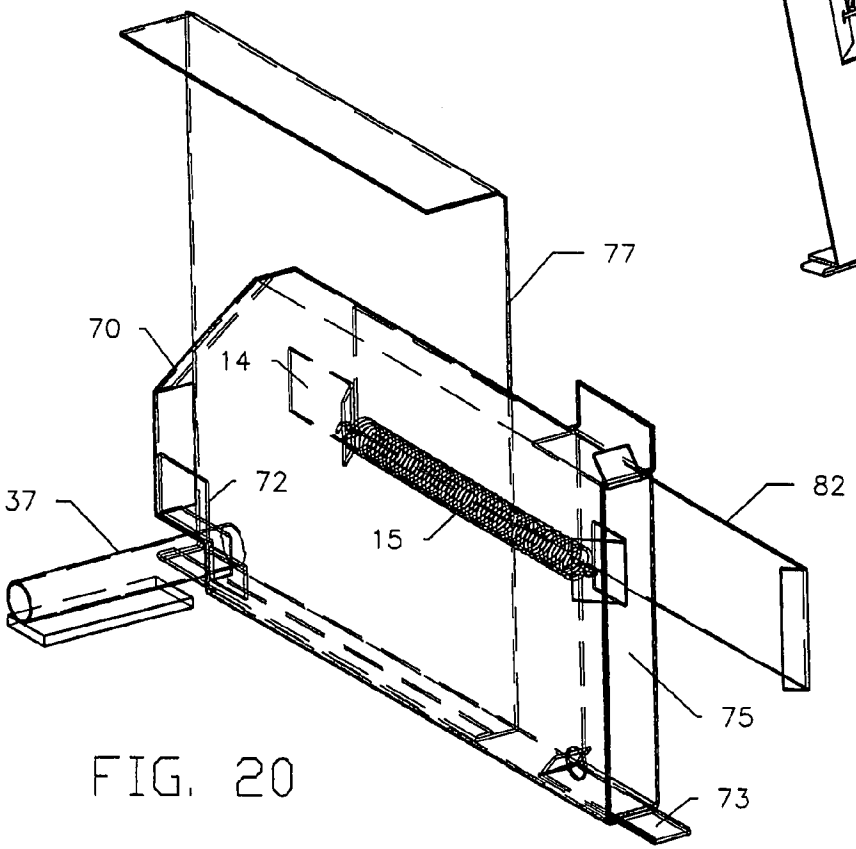
FIG. 20 is a perspective view of various component parts of the invention with hidden components depicted by hidden lines.
Figure 22:
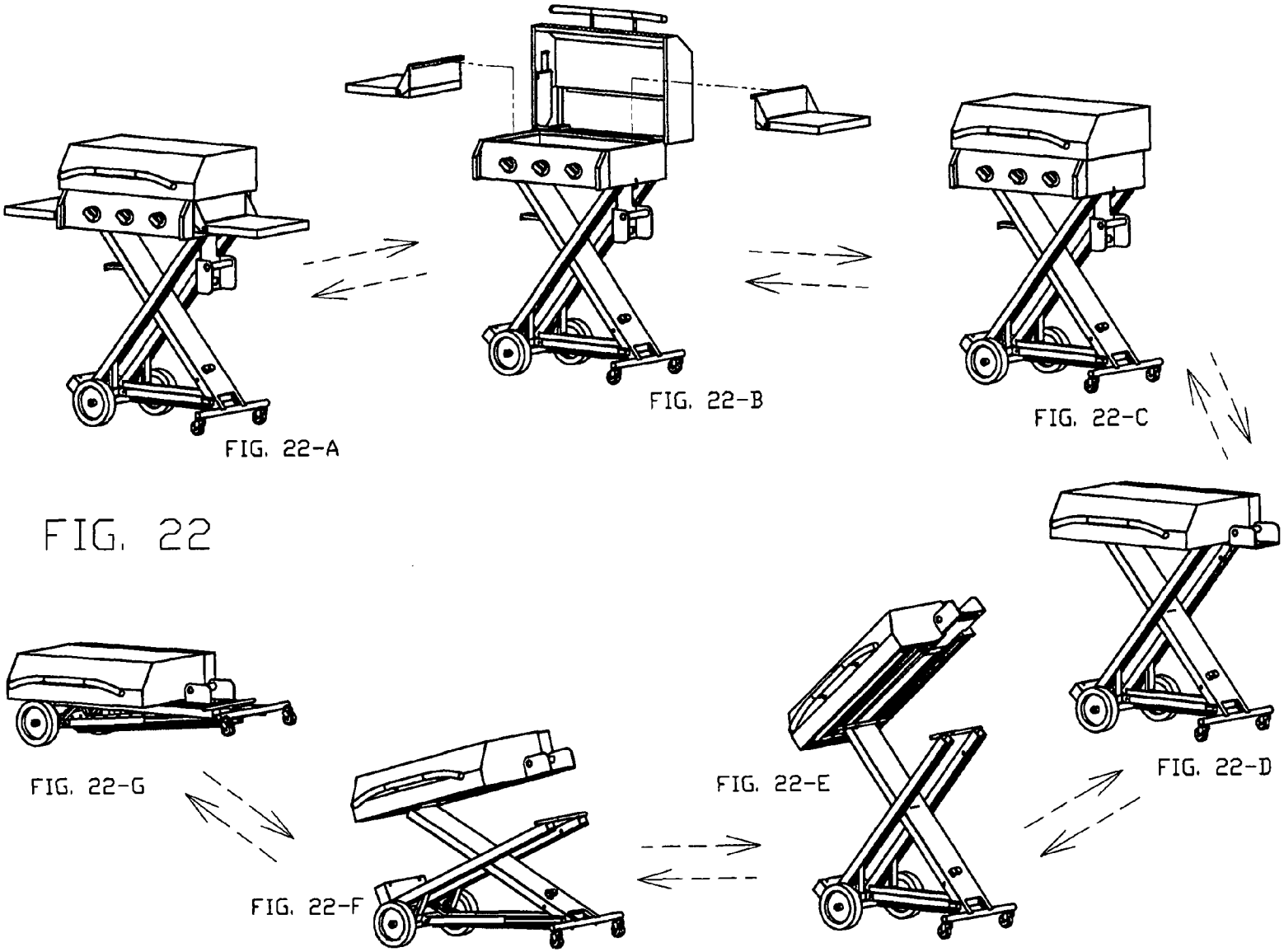
FIG. 22 is an illustration with five perspective views which illustrate the process by which the invention changes from expanded form to collapsed form similar to FIG. 1 but with the two locking sub-assemblies added.
Figure 23:
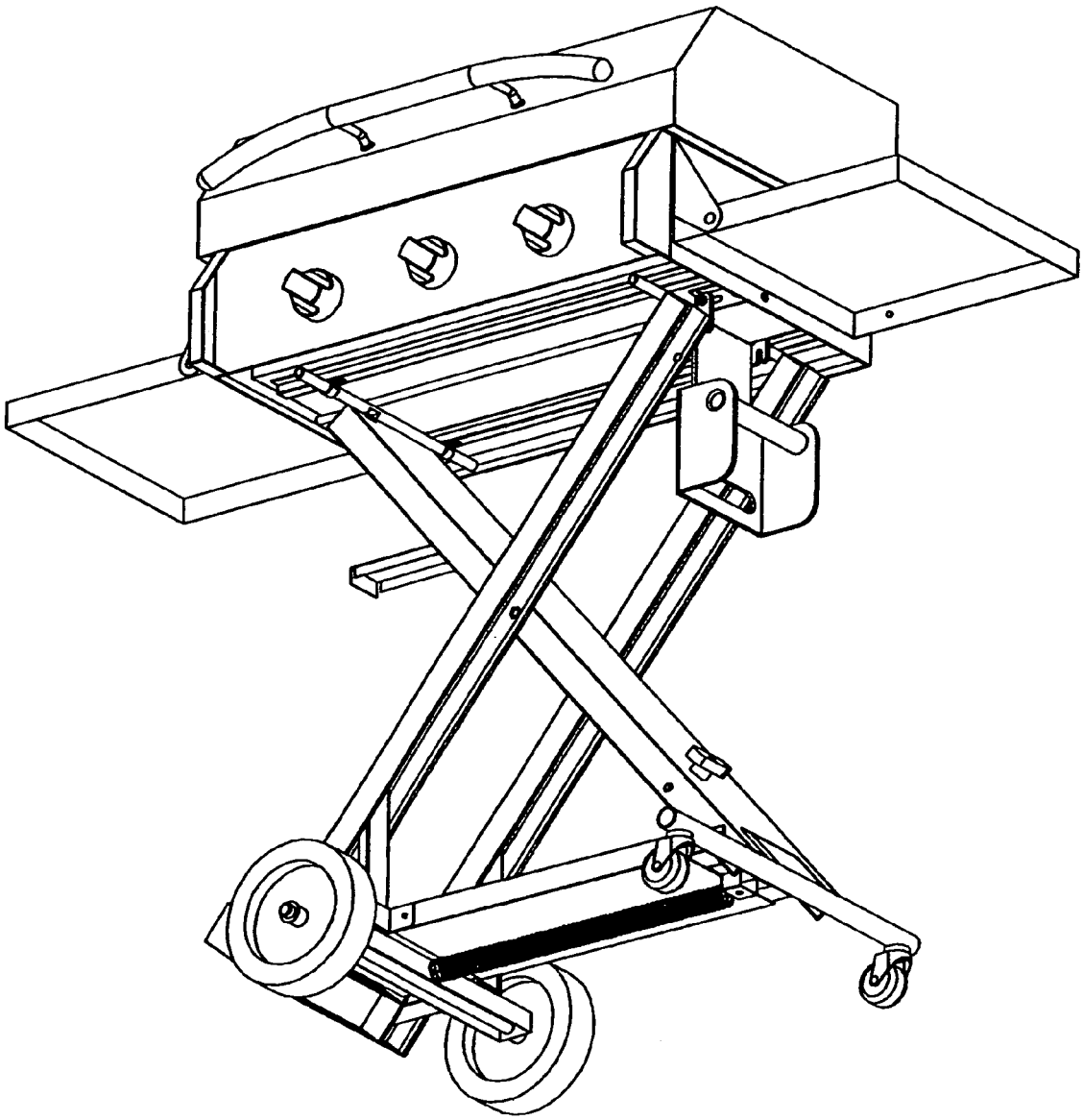
FIG. 23 is a perspective illustration of the system from below with the system expanded for use.
Figure 24:
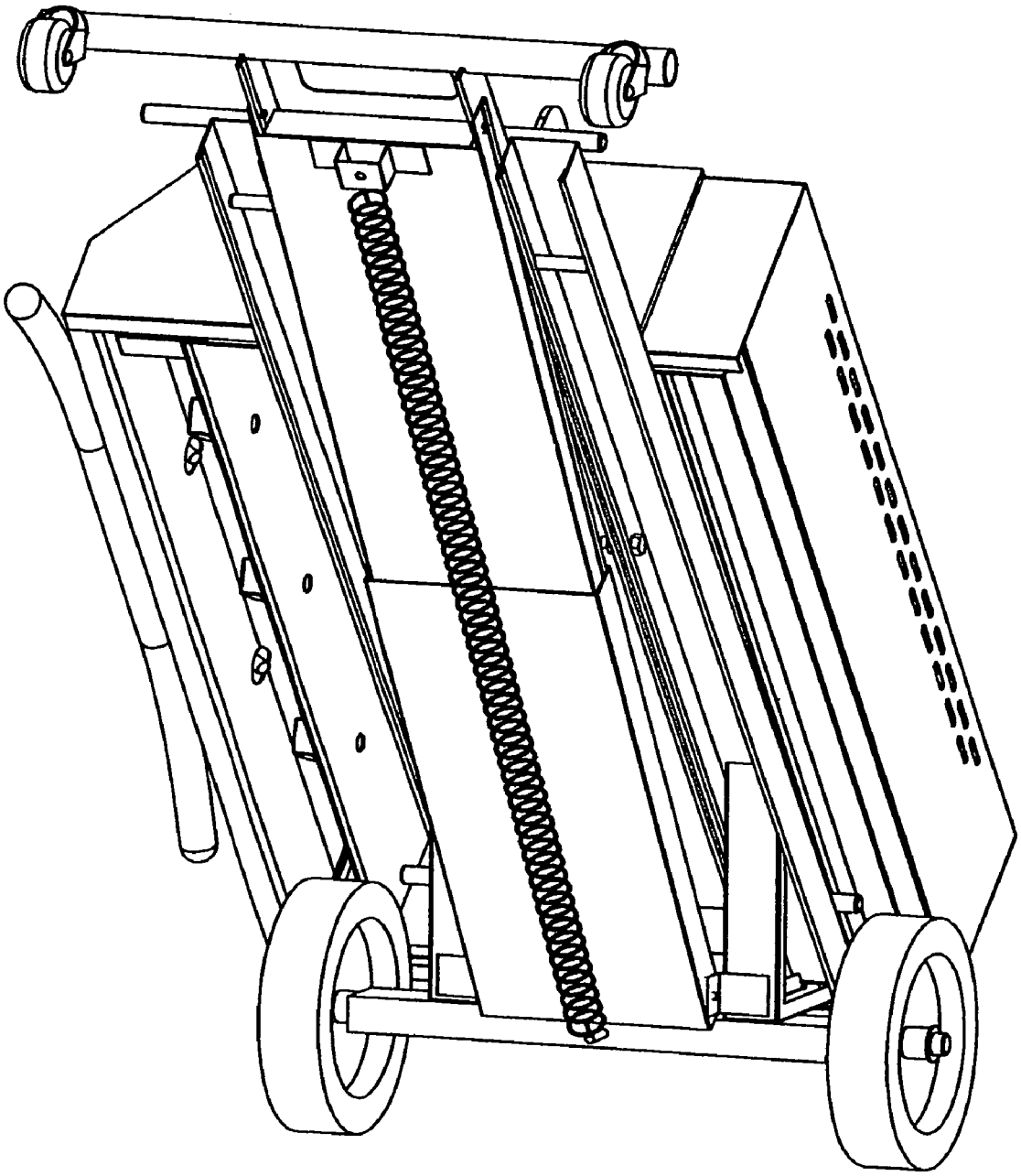
FIG. 24 is a perspective illustration of the system from below with the system collapsed.
Figure 25:
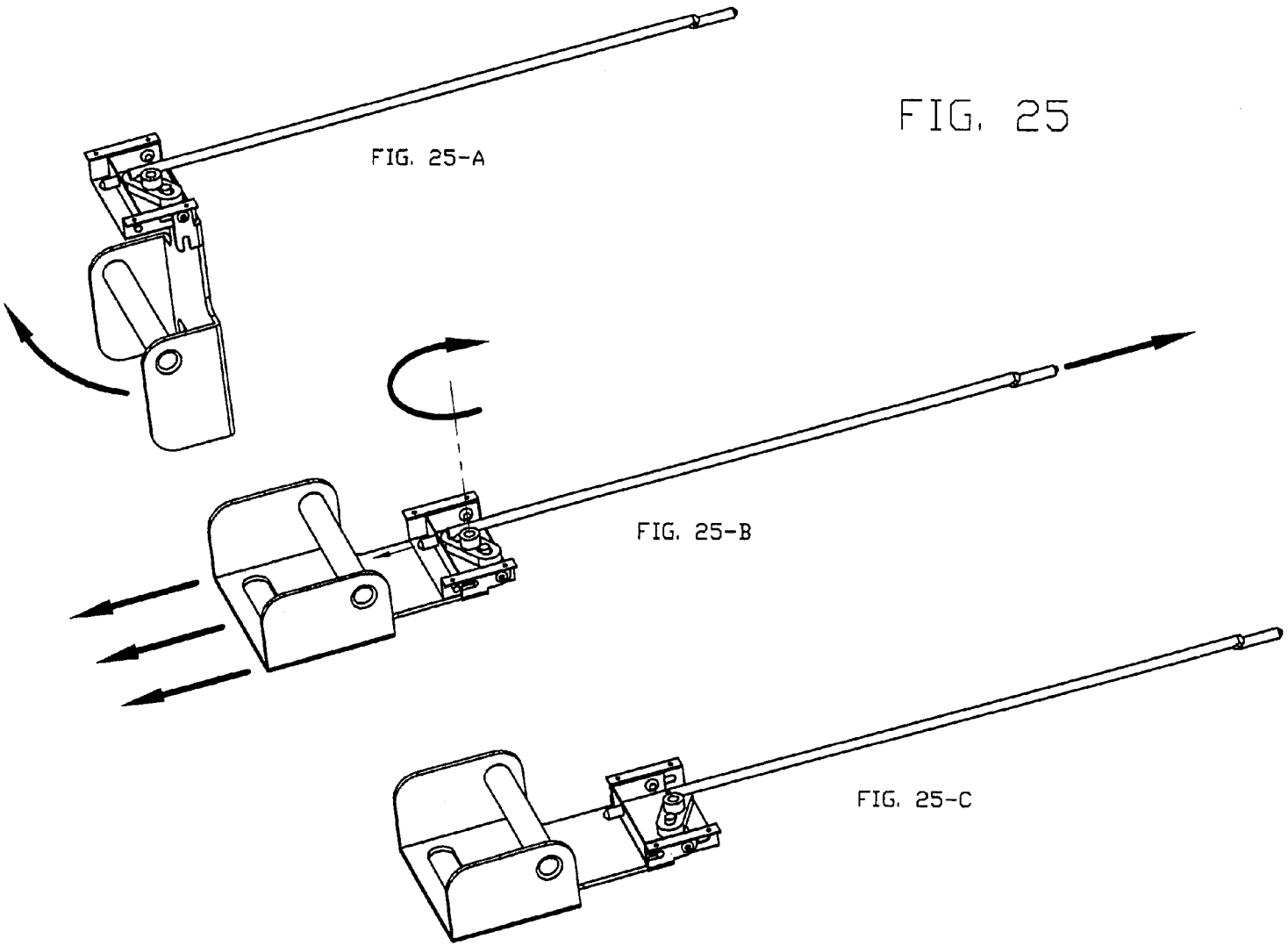
FIG. 25 is a perspective illustration of the upper locking sub-assembly shown being moved in FIGS. 25-A, 25-B and 25-C from the unlocked to locked orientations.
Figure 26:
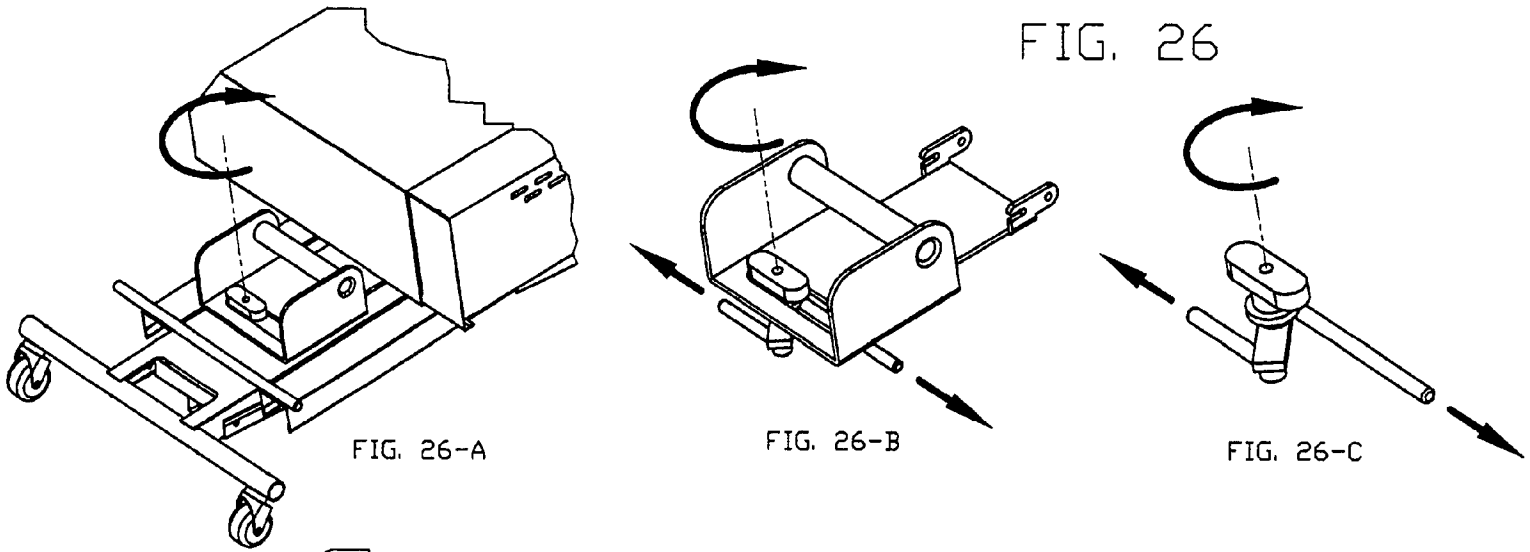
FIG. 26 is a perspective illustration of the lower locking sub-assembly shown being moved in FIGS. 26-A, 26-B and 26-C from the unlocked to locked orientations.
Figure 27:
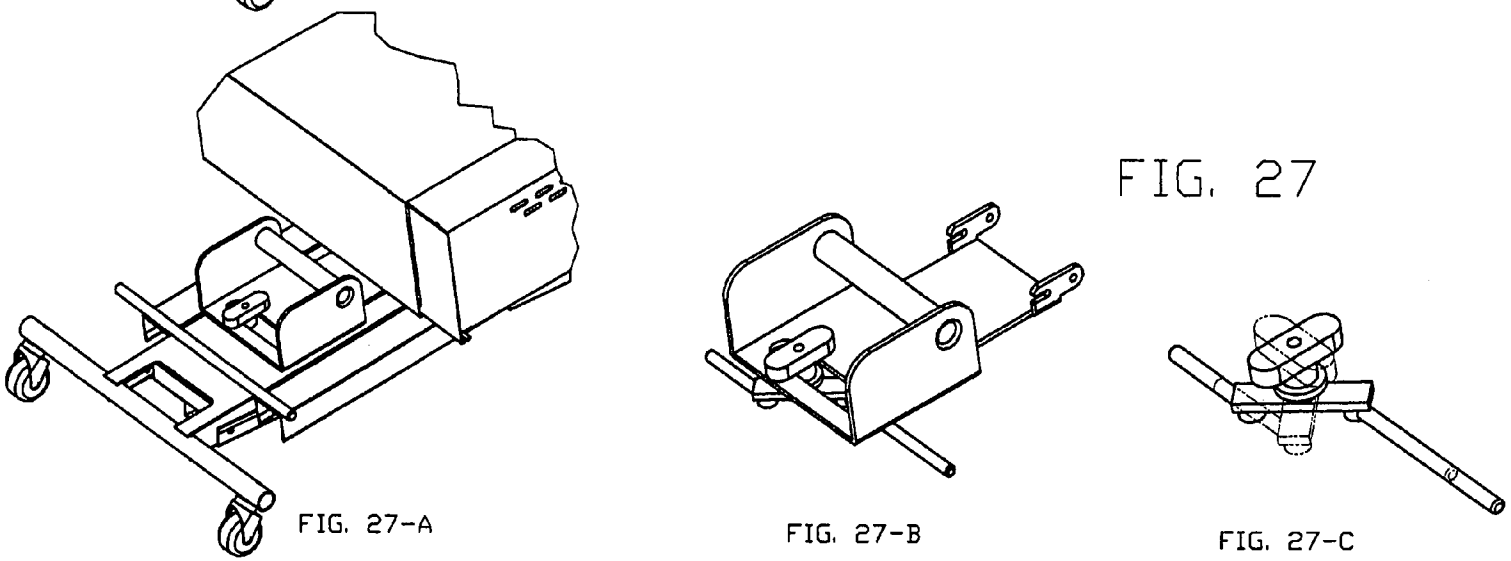
FIG. 27 is a perspective illustration of the lower locking sub-assembly shown being moved in FIGS. 27-A, 27-B and 27-C from the locked to unlocked orientations.
Figure 28:
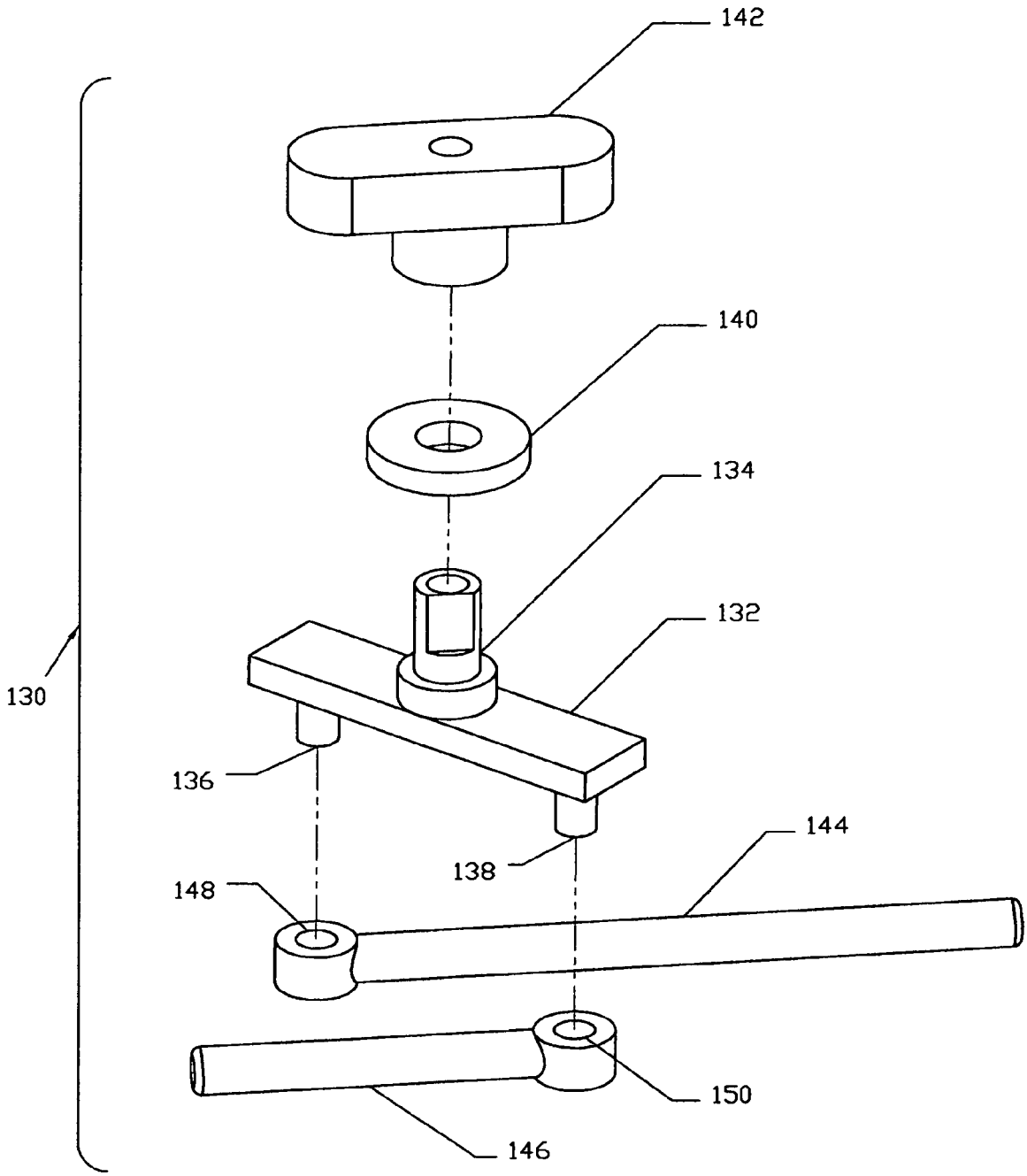
FIG. 28 is an exploded perspective illustration of the lower locking sub-assembly.
Figure 29:
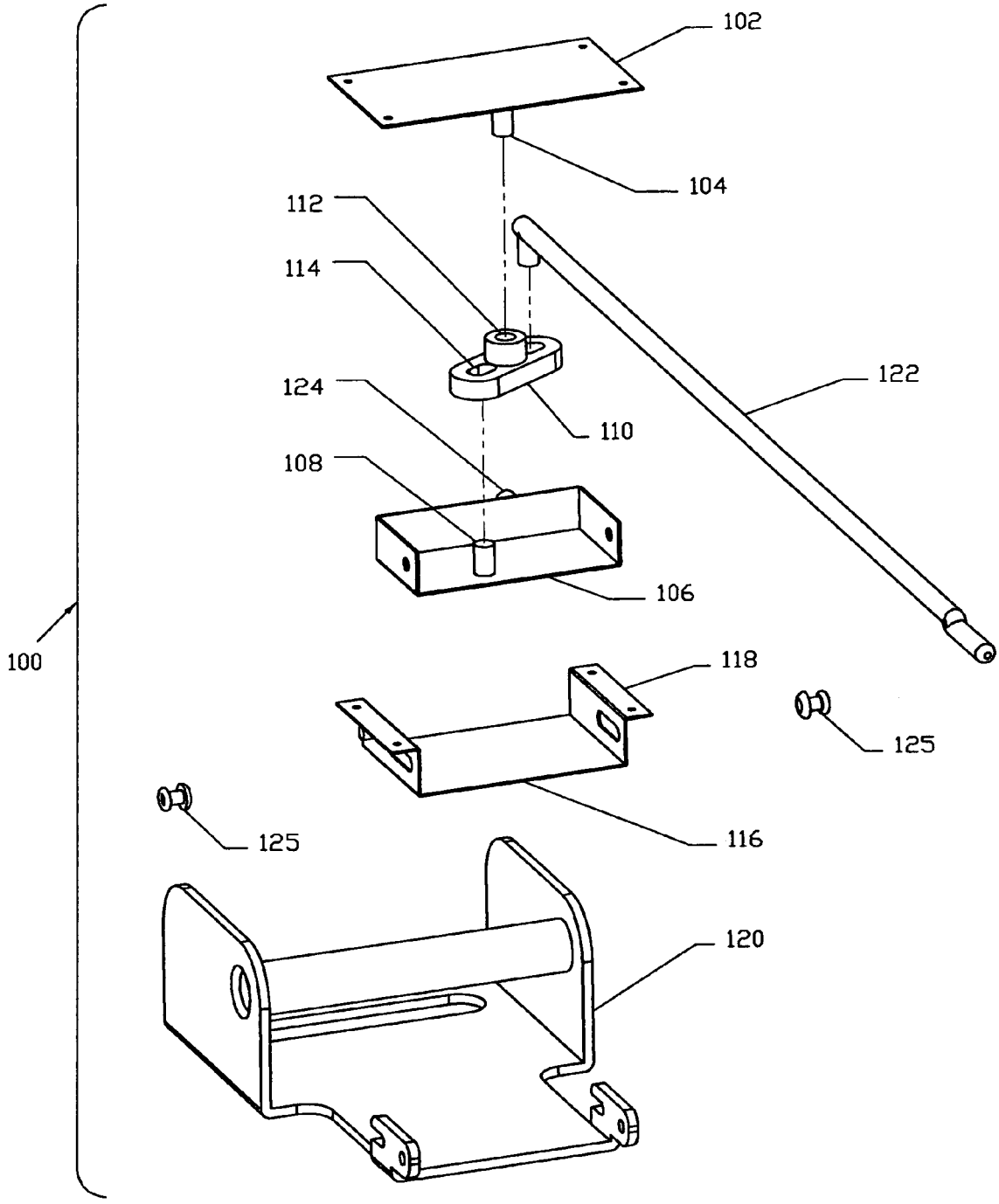
FIG. 29 is an exploded perspective illustration of the upper locking sub-assembly.

The end of right insert stop arm 82 is fold back to form an acute angle so as to prevent it from sliding past right keeper bracket 75. Right keeper bracket 75 serves to limit the travel of right insert stop arm 82 along with the rest of posterior lid 3, as well as support the weight of posterior lid 3 and cooking tub 4 when assembly is in collapsed form 2, 3, 4 as in FIG. 2. Support bracket 80 serves to distribute the weight of cooking tub 4 along the inside face of posterior lid 3 as well as hold drip pan 16 in place within cooking tub 4. As depicted in FIG. 20, right pivot bearing 72 acts as a load bearing component of lid assembly 2, 3 as it pivots about right hinge pivot 37.

Fold tab ridge 79 serves three purposes. First, it adds rigidity to lid insert top 78. Second, tabs at either end are to be folded down behind right hinge pivot 37 and left hinge pivot 36 after lid assembly 2,3 is positioned onto cooking tub 4 so as to keep these elements in place. Third, it acts to limit the angle to which the lid assembly 2, 3 of barbecue apparatus 1, can be opened by coming into contact with the upper-rear of cooking tub 4 when lid assembly 2, 3 is lifted fully open during normal use. Finally, slots punched or cut into lid insert top 78 serve as exhaust vents to allow spent, heated air to escape during normal use of barbecue apparatus 1 when lid assembly 2, 3 is in the closed position. Sufficient spent air must be allowed to escape in order to allow proper burning of flames from burners 65 during normal use of barbecue apparatus 1.

Figure 4:
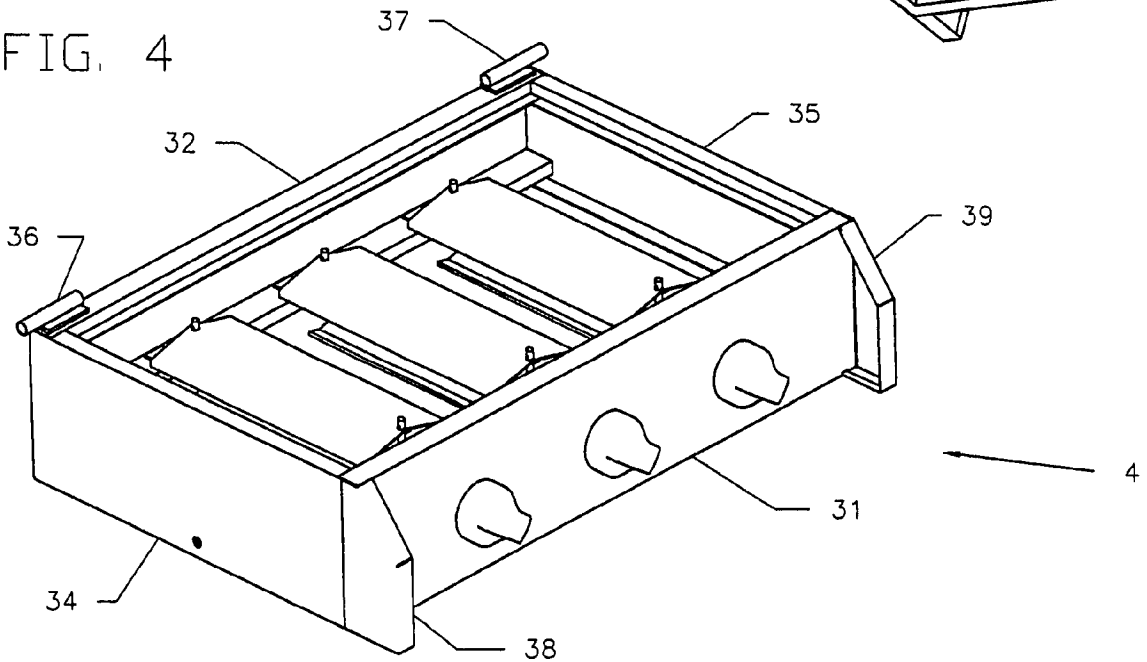
FIG. 4 is a perspective view from a top angle of one element of the invention.

With reference now to FIGS. 4, 5, and 12, the assembly of cooking tub 4 will be detailed. Tub front 31 and tub back 32 are typically welded, along the seams of contact, to left tub side 34 and right tub side 35. Tub bottom 33 is positioned between left tub side 34 and right tub side 35 and typically welded to tub front 31, left tub side 34, and right tub side 35 along the seams of contact. This forms the basic structure of cooking tub 4. Drip pan 16 slides loosely into place between tub back 32 and tub bottom 33 as shown into position shown in FIG. 5. Drip pan 16 simply slides in or out of place and allows for easy cleaning of grease drippings which are common when cooking on a barbecue device.

As visible in FIG. 12, three of the four sides of drip pan 16 are folded over and are to be typically welded along the seams. This is intended to prevent grease in the pan from spilling out over the sides when its position is shifted about angularly. However, the folded over side along rearmost edge of drip pan 16 must be kept minimal enough so as to allow sufficient fresh air to enter cooking tub 4 through open area between top of drip pan 16 and bottom of tub back 32 during normal use of barbecue apparatus 1. Fresh air must be allowed to enter cooking tub 4 in order for flames from burners 65 to burn properly. Though not shown in drawings, ribs may be added along face of drip pan 16 for strength and to prevent it from warping when heated. Left hinge pivot 36 and right hinge pivot 37 are attached by a typical weld to tub back 32 in respective positions depicted in FIG. 4. Similarly, left knob guard 38 and right knob guard 39, which are designed to prevent lid assembly 2, 3 from contacting knobs 40 when being collapsed, are attached by a typical weld to tub front 31 in respective positions depicted in FIG. 4. Cart mount receiver 64 is typically welded to underside of tub bottom 33 in position shown in FIG. 5. This position should be near the apparent center of the rectangular area underneath cooking tub 4. Cart mount receiver 64 is intended to fit around cart mount hitch 63 of folded cart-stand 5 and functions to hold cooking tub 4 in place while being transported. As depicted in FIG. 5, left lid lock 7 and right lid lock 8 are lined up with holes in left tub side 34 and right tub side 35 respectively, and attached to the underside of tub bottom 33 by a typical weld. Tapered ends of left lid lock pin 24 and right lid lock pin 28 are to face outward. Heat deflector 21 is typically welded to the underside of burner 65, functioning to deflect heat from burner 65 away from drip pan 16 during normal use of barbecue apparatus 1, so as to prevent heat-induced deformation of drip pan 16. Vaporizer 22 is mounted above burner 65. Two "t"-shaped members at top of burner 65 fit through holes at either end of vaporizer 22, which is then fixed into place by either a typical weld or by a inserting a cotter pin through a drilled hole near top of "t" shaped member. Vaporizer 22 serves both to protect burner 65 form and also to provide flavor to the food by "vaporizing" any grease that may drip from food being cooked. Three assemblies of burner 65, heat deflector 21, and vaporizer 22 are used. Each is inserted through one of three large openings in front face of tub bottom 33 and fixed in place by a screw or rivet inserted through a hole in flat end of burner 65 into one of three holes in tub back 32.

This completes the assembly as presented in the drawings. However, left out of the drawings are three gas valves, a valve manifold, a hose and regulator, and an electric ignition system all of which are typical to the gas barbecue grill industry and, hence, not shown in drawings, they are to be part of the finished, working assembly of collapsible barbecue apparatus 1.

Figure 7:
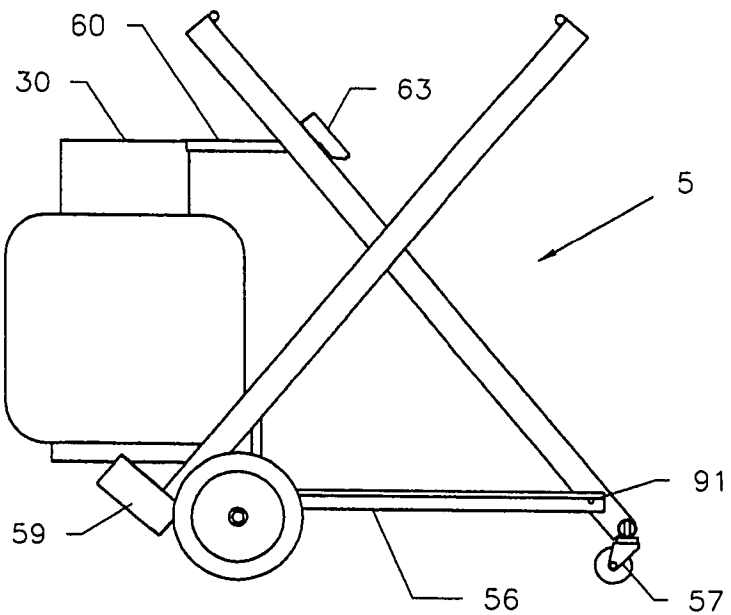
FIG. 7 is a front elevation view of one element of the invention.
Figure 6:
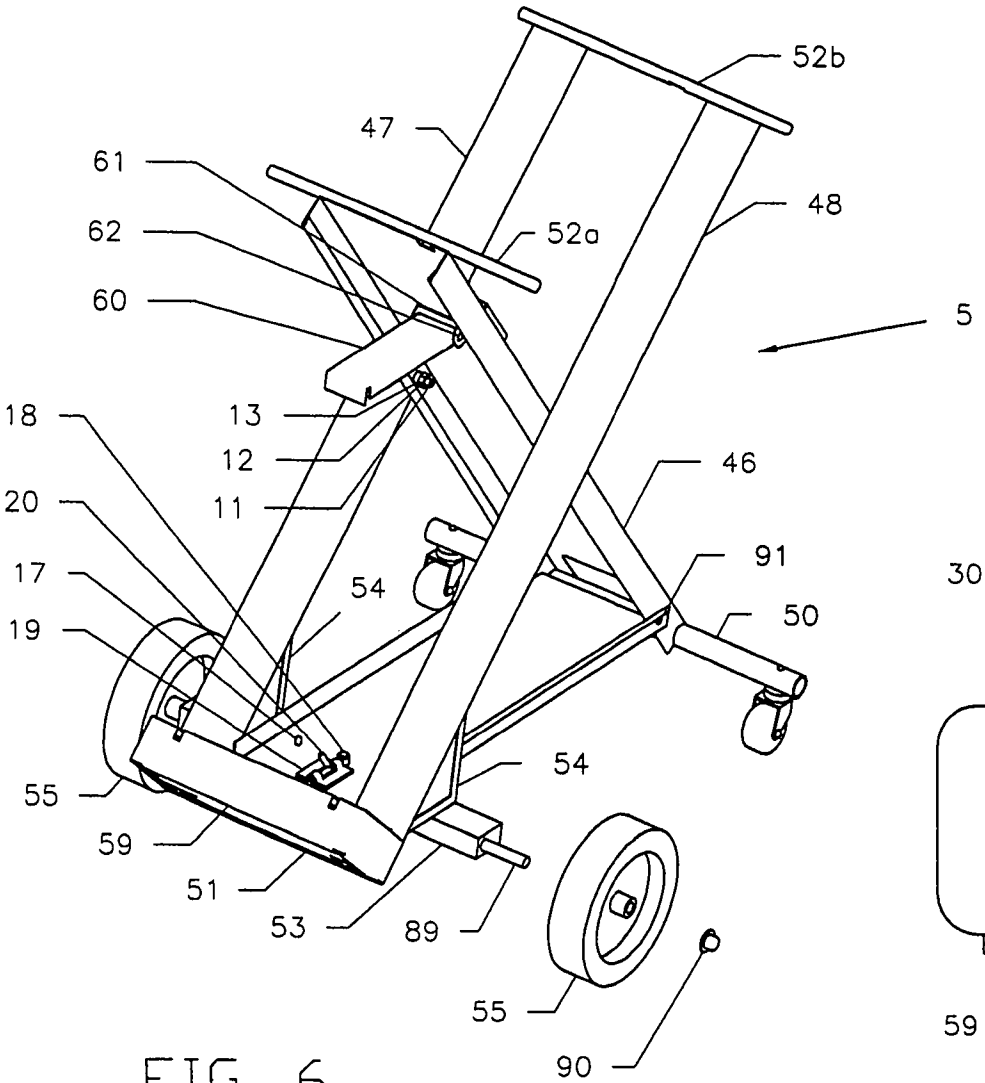
FIG. 6 is a partially-exploded perspective view of one element of the invention.
Figure 13:
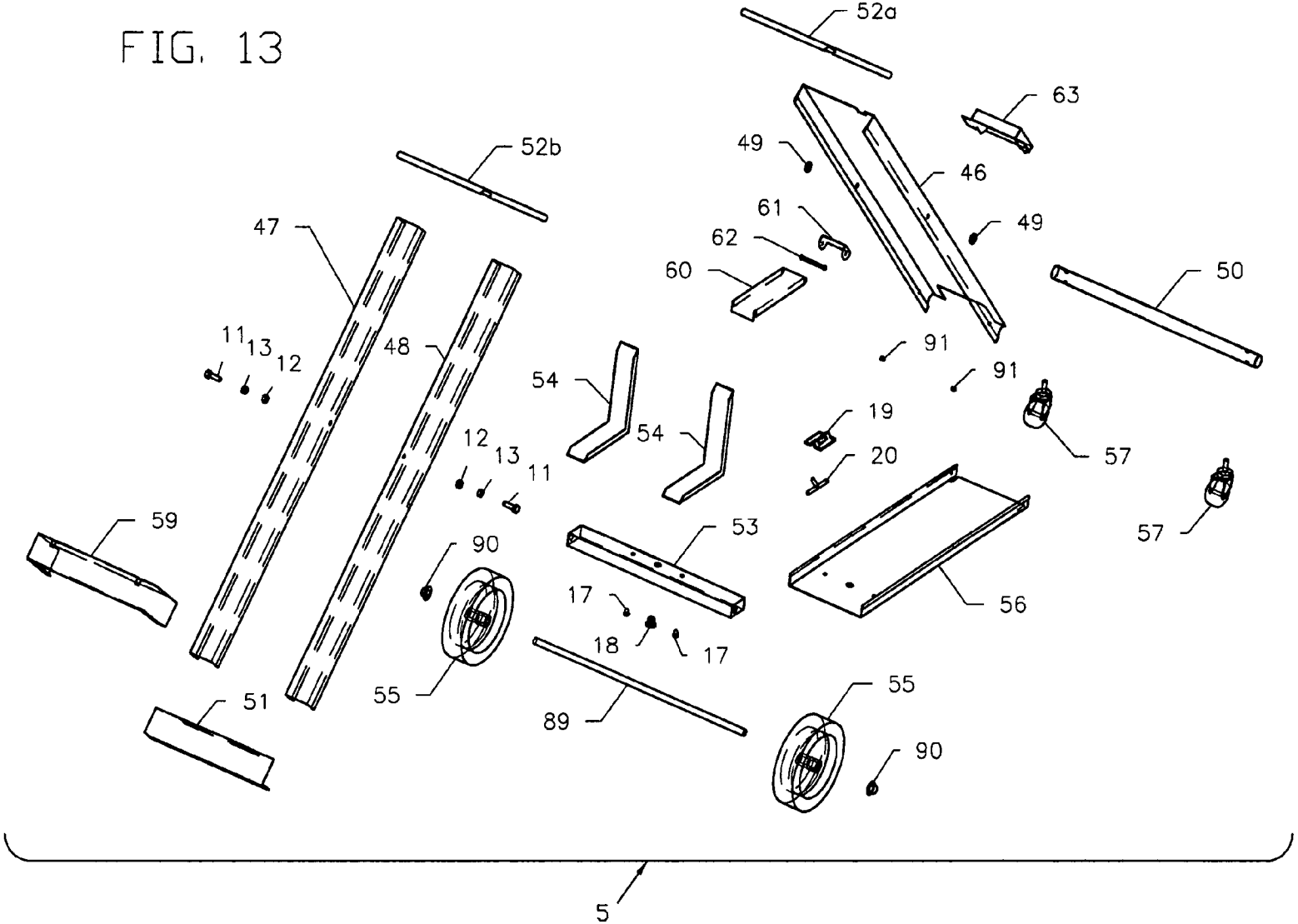
FIG. 13 is an exploded perspective view of the various component parts of one element of the invention.

With reference now to FIGS. 6, 7, 13, 15, and 16 the assembly and functions of cart-stand 5 will be detailed. Cart-stand 5 consists of inner beam 46 attached between front-outer beam 48 and rear-outer beam 47 as shown in FIG. 6-7. One spacer 49, shown in FIG. 13, is aligned and mated with each of the holes in inner beam 46, then mated with respective holes in front-outer beam 48, and rear-outer beam 47. Spacer 49 acts to separate inner beam 46 from front-outer beam 48, and rear-outer beam 47, thus minimizing contact surfaces between the beams. As shown positioned in FIGS. 6-7, and 13, front-outer beam 48 is attached to the front-facing side of inner beam 46 by bolt 11 positioned into the hole in front-outer beam 48, through spacer 49, and through the hole in inner beam 46. Spacer 13 is then placed around end of bolt 11 and secured snugly in place by nylon lock nut 12. Rear-outer beam 47 is attached in the same fashion to the rear-facing side of inner beam 46.

Cross beam 51 is attached between bottom ends of front-outer beam 48 and rear-outer beam 47 by a typical weld to each beam. Cart handle 50 is attached, by a typical weld, at the bottom end of inner beam 46 in position as oriented in FIG. 6, with holes aligned vertically. One castor wheel 57 is fitted into each hole at either end of cart handle 50 and secured in place by method common to the art. Castor wheel 57 is typically a standard castor with a swiveling hard rubber or plastic wheel as is common in the industry. Top-bar 52*a* is attached at the top of inner beam 46 by a typical weld in the position depicted in FIG. 6-7, with notch in bar situated more towards the front and facing down. The notch in top-bar 52*a* serves to allow left lid lock pin 24 to slide freely around top-bar 52*a* to assist in securing cooking tub 4 to cart-stand 5. Similarly, top-bar 52*b* is attached, by a typical weld, at the top of rear-outer beam 47 and front-outer beam 48 in the position depicted in FIG. 6-7, with notch in bar situated more towards the front and facing down. The notch in top-bar 52*b* serves to allow right lid lock pin 28 to slide freely around top-bar 52*b* to assist in securing cooking tub 4 to cart-stand 5.

One axle housing bracket 54 is typically welded to the under-side of rear-outer beam 47 in the position depicted in FIGS. 6-7. Similarly, one axle housing bracket 54 is typically welded to the under-side of front-outer beam 48 in the position depicted in FIGS. 6-7. Axle housing 53 is centered between and attached to the bottom of each axle housing bracket 54 by a typical weld. Axle housing 53 has three holes drilled or punched into it at locations depicted in FIG. 13. These holes are intended for pins that will lock connecting tray 56 into place, to be described in more depth in the following paragraph. Wheel axle 89 is positioned through holes in either end of axle housing 53.

One wheel 55 is placed on each end of wheel axle 89 and each is held in place by one axle cap 90 placed over each end of wheel axle 89. Wheel 55 is to be constructed of either plastic, rubber, or a combination of plastic and rubber, and may have a metal hub with or without a bearing. Connecting tray 56 is attached to the front-facing side of inner beam 46 by rivet 91 and similarly to the rear-facing side of inner beam 46 with another rivet 91. Each rivet 91 should be of material and diameter so as to withstand the shear forces that will develop when cart-stand 5 is loaded by the weight of the assembly of anterior lid 2, posterior lid 3, cooking tub 4, two of side shelf 6 and any additional items that may be placed on this assembly during normal use of barbecue apparatus 1.

Figure 16:
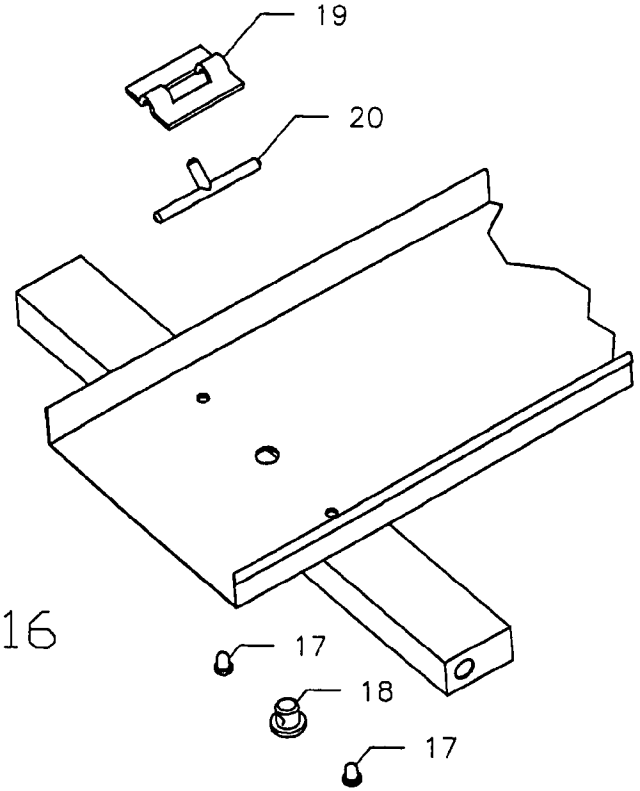
FIG. 16 is an exploded perspective view from a top angle of various components of the invention.
Figure 15:
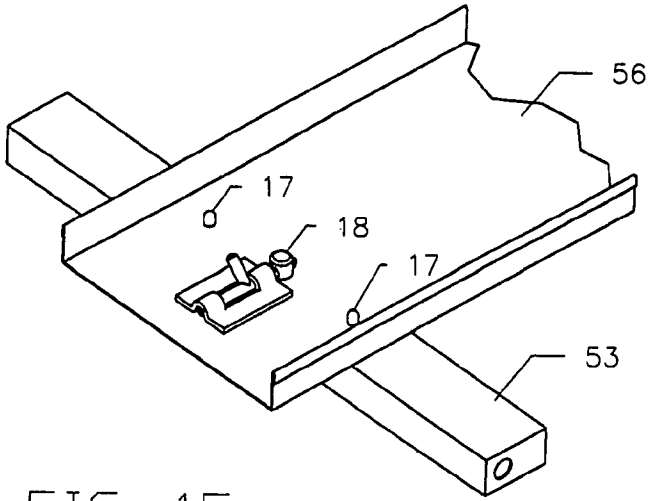
FIG. 15 is a perspective view from a top angle of various components of the invention.

When cart-stand 5 is in unfolded form, connecting tray 56 will serve to fix, in place, the respective positions of inner beam 46, rear-outer beam 47, and front-outer beam 48 in an "X"-shaped configuration shown in FIG. 7. Connecting tray 56 will attach to axle housing 53 by method shown in FIGS. 6 and 15. FIG. 16 shows two of housing-tray pin 17, and one tray lock pin 18. These three pins are positioned as shown in FIG. 15, through holes in axle housing 53, and each attached by a typical weld placed on the underside of axle housing 53. Locking pin 20 and locking pin guide 19 are then positioned on connecting tray 56 in position depicted in FIGS. 13 and 15. Locking pin guide 19 is typically welded to connecting tray 56 with locking pin 20 free to slide from side-to-side within it. When cart-stand 5 is in unfolded form, connecting tray 56 is positioned over housing-tray pins 17, and tray lock pin 18 and locking pin 20 is moved through hole in tray lock pin 18 to fix connecting tray 56 in place as shown in FIG. 15.

Fuel tank 30, as shown in FIG. 7, is held into position by tank mount base 59 and tank mount arm 60. Tank mount base 59 is attached over top of cross beam 51 and attached by a typical weld to rear-outer beam 47 and front-outer beam 48, while oriented in position shown in FIGS. 6-7, with slots facing upward. These slots are used to secure base of fuel tank 30 in place. Tank mount arm bracket 61 is attached by a typical weld to the under-side of inner beam 46 in position shown in FIG. 6. Tank mount arm bracket 61 is positioned so as to be fairly level with the height at the top of a fuel tank 30. Tank mount arm 60 is attached to tank mount arm bracket 61 by tank mount arm pin 62, shown in FIGS. 6 and 13, which is a typical pin as known to the art. Tank mount arm rests atop rim of carrying handle of fuel tank 30 to hold it in upright position when mounted on tank mount base 59. Fuel tank 30 is to be a standard fuel tank, such as a 20 lb propane tank, as known to the gas barbecue grilling industry.

From the above descriptions, it should be understood that the present invention is a collapsible barbeque system comprised of a plurality of components. Such components in their broadest context include a tub and a lid. Such components are individually configured and correlated with respect to each other so as to attain the desired objective.

First provided is a tub 4. The tub is in a rectilinear configuration. The tub has a rear face. The tub has a front face. The rear and front faces are separates by a depth. The tub has side faces. The side faces are provided between the front and rear faces. The side faces are separated by a width. The tub has a closed bottom. The tub has an open top. The bottom and top are separated by a height. The tub has heating elements. The tub has rotary controls 40. The rotary controls are provided in the front face. The rotary controls are adapted to be manipulated by a user during operation and use.

A lid 2, 3 is provided. The lid is in a rectilinear configuration. The lid has a posterior element 3. The lid has an anterior element 2. The posterior element has a rear face. The posterior element has an open front. The rear faces and open front are separated by a depth. The posterior element has side faces. The side faces are provided between the front and rear face. The side faces are separated by a width. The posterior element has an open bottom. The posterior element has a closed top. The bottom and top are separated by a height. The anterior element has a front face. The anterior element has an open rear. The front face and open rear are separated by a depth. The anterior element has side faces. The side faces are provided between the rear and front face. The side faces are separated by a width. The posterior element has an open bottom. The posterior element has a closed top. The open bottom and closed top are separated by a height. The rear of the anterior element is adapted to slidably receive the front of the posterior element. In this manner movement is provided between an expanded and contracted orientation. When in the expanded orientation the anterior element only partially receives the posterior element. In this manner the lid is adapted to be lowered to receive and totally encompass the tub during storage. When in the collapsed orientation the posterior element is fully received by the anterior element. In this manner the lid is adapted to be resting atop the tub during use. A hinge 37 is attached to the top of the rear face of the tub for pivotally coupling the lid to the tub.

Provided next is a removable stand 5. The stand has a central leg 46. The stand has side legs 47, 48. Each leg has an upper end. The upper end is adapted to couple to the lower face of the tub and a lower end. The stand has a lower support 56. The lower support has wheels 55. The lower support has casters 57. The casters are coupled to the lower ends of the legs. The legs have pivot pins 11. The pivot pins couple the legs at central extents intermediate the upper and lower ends. The legs are pivotable between a folded orientation and an unfolded orientation. In the folded orientation the lower support is adjacent to the tub and adapted for storage. In the unfolded orientation the lower support is spaced from the tub and adapted for use.

An upper locking sub-assembly 100 includes a base plate 102 attached beneath the tub with a downwardly extending post 104. An upper pan 106 has an upwardly extending pin 108 receiving one lateral aperture of the toggle arm. A toggle arm 110 has a central bearing surface 112 and lateral apertures 114 adapted to oscillate on the sleeve. A lower pan 116 slidably receives the upper pan with lateral supports 118 attached to the base plate. A handle 120 at adapted to reciprocate the upper pan to oscillate the toggle arm through pins 125. A long lock rod 122 has a near end coupled to one lateral aperture in the toggle arm and a free end movable into an aperture in the lid. A short lock rod 124 is also movable into an aperture in the other side of the lid. The lock rods are adapted to move between a retracted unlocking orientation and an extended locking orientation coupling the lid to the tub.

A lower locking sub-assembly 130 includes a cross bar 132 with a centrally positioned upwardly extending pivot pin 134 extending upwardly through the central leg of the stand. The cross bar is located beneath the central leg with downwardly extending fingers 136, 138. The pivot pin has a washer 140 and a handle 142 above the central leg. Locking bars 144, 146 have apertured interior ends 148, 150 receiving the fingers. The locking bars have free ends movable into apertures in the side legs to lock the legs in a collapsed orientation.

Provided last is a plurality of shelves 6. Each shelf has a horizontal section below. The horizontal section receives cooking-related objects. Each shelf has a hook shaped end above. In this manner each shelf may be removably positioned over aside edge of the tub. Each shelf has a vertical section. The vertical section couples the horizontal section and the hook shaped end.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collapsible barbecue system reconfigurable between an expanded operative orientation and a contracted inoperative orientation, the system comprising, in combination:

a tub having a rectilinear configuration with a rear face and a front face separated by a depth and with side faces between the front and rear faces separated by a width, the tub having a closed bottom and an open top separated by a height, the tub containing heating elements with controls adapted to be manipulated by a user during operation and use; and a lid having a rectilinear configuration with a posterior element and an anterior element, the posterior element having a rear face and an open front separated by a depth, the posterior element having side faces between the front and rear faces separated by a width, the posterior element having an open bottom and a closed top separated by a height, the anterior element having a front face and an open rear separated by a depth, the anterior element having side faces between the rear and front face separated by a width, the posterior element having an open bottom and a closed top separated by a height, the rear of the anterior element adapted to slidably receive the front of the posterior element for movement between an expanded and contracted orientation, when in the expanded orientation the posterior element is only partially received in the anterior element whereby the lid is adapted to be lowered to receive and totally encompass the tub during storage, when in the collapsed orientation the posterior element being fully received by the anterior element whereby the lid is adapted to be resting atop the tub during use, the rearward inner sides of the posterior section having hinges for pivotally coupling the lid to the tub.

2. A collapsible barbecue system comprising:

a tub having a generally rectilinear configuration with a rear face and a front face and with side faces between the front and rear faces, the tub having a closed bottom and an open top separated by a height, the tub containing heating elements with controls in the front face adapted to be manipulated by a user during operation and use;

a lid having a generally rectilinear configuration with a posterior element and an anterior element, the posterior element having a rear face and an open front and with side faces between the front and rear face, the posterior element having an open bottom and a closed top, the anterior element having a front face and an open rear and with side faces between the rear and front face, the posterior element having an open bottom and a closed top, the rear of the anterior element adapted to slidably couple with respect to the front of the posterior element for movement between an expanded and contracted orientation; and an upper locking sub-assembly including a base plate attached beneath the tub with a downwardly extending post, an upper pan with an upwardly extending post receiving a lateral aperture in a toggle arm, a toggle arm having a central bearing surface and lateral apertures adapted to oscillate on the post, a lower pan slidably receiving the upper pan with lateral supports attached to the base plate, and a handle with pins adapted to reciprocate the upper pan to oscillate the toggle arm, a long lock rod having a near end coupled to an aperture in the toggle arm and a free end movable into an aperture in the lid, and a short locking rod, the lock rods adapted to move between a retracted unlocking orientation and an extended locking orientations coupling the lid to the tub.

3. A collapsible barbecue system comprising:

a tub having a generally rectilinear configuration with a rear face and a front face and with side faces between the front and rear faces, the tub having a closed bottom and an open top separated by a height, the tub containing heating elements with controls in the front face adapted to be manipulated by a user during operation and use;

a lid having a generally rectilinear configuration with a posterior element and an anterior element, the posterior element having a rear face and an open front and with side faces between the front and rear face, the posterior element having an open bottom and a closed top, the anterior element having a front face and an open rear and with side faces between the rear and front face, the posterior element having an open bottom and a closed top, the rear of the anterior element adapted to slidably couple with respect to the front of the posterior element for movement between an expanded and contracted orientation;

a removable stand having a central leg and side legs, each leg having an upper end adapted to couple to the lower face of the tub and a lower end, a lower support with wheels and casters coupled to the lower ends of the legs, the legs having pivot pins coupling the legs at central extents intermediate the upper and lower ends, the legs being pivotable between a folded orientation with the lower support adjacent to the tub and adapted for storage and an unfolded orientation with the lower support spaced from the tub and adapted for use; and a lower locking sub-assembly including a cross bar with a centrally positioned upwardly extending pivot pin extending upwardly through the central lea of the stand, the cross bar located beneath the central leg with downwardly extending fingers, the pivot pin having a washer and a handle above the central leg, and locking bars with apertured interior ends receiving the fingers, the locking bars having free ends movable into apertures in the side legs to lock the legs in a collapsed orientation.

4. A collapsible barbecue system for cooking on a grill with a system which is reconfigurable between an expanded operative orientation adapted for use and a contracted inoperative orientation adapted for storage, all in a safe, convenient and economic manner, the system comprising, in combination:

a tub having a rectilinear configuration with a rear face and a front face separated by a depth and with side faces between the front and rear faces separated by a width, the tub having a closed bottom and an open top separated by a height, the tub containing heating elements with rotary controls in the front face adapted to be manipulated by a user during operation and use;

a lid having a rectilinear configuration with a posterior element and an anterior element, the posterior element having a rear face and an open front separated by a depth and with side faces between the front and rear face separated by a width, the posterior element having an open bottom and a closed top separated by a height, the anterior element having a front face and an open rear separated by a depth and with side faces between the rear and front face separated by a width, the posterior element having an open bottom and a closed top separated by a height, the rear of the anterior element adapted to slidably receive the front of the posterior element for movement between an expanded and contracted orientation, when in the expanded orientation the anterior element being only partially receiving the posterior element whereby the lid is adapted to be lowered to receive and totally encompass the tub during storage, when in the collapsed orientation the posterior element being fully received by the anterior element whereby the lid is adapted to be resting atop the tub during use, the rearward inner sides of the anterior section having hinges for pivotally coupling the lid to the tub;

a removable stand having a central leg and side legs, each leg having an upper end adapted to couple to the lower face of the tub and a lower end, a lower support with wheels and casters coupled to the lower ends of the legs, the legs having pivot pins coupling the legs at central extents intermediate the upper and lower ends, the legs being pivotable between a folded orientation with the lower support adjacent to the tub and adapted for storage and an unfolded orientation with the lower support spaced from the tub and adapted for use;

an upper locking sub-assembly including a base plate attached beneath the tub with a downwardly extending post, an upper pan with an upwardly extending post receiving a lateral aperture in a toggle arm, a toggle arm having a central bearing surface and lateral apertures adapted to oscillate on the post, a lower pan slidably receiving the upper pan with lateral supports attached to the base plate, and a handle with pins adapted to reciprocate the upper pan to oscillate the toggle arm, a long lock rod having a near end coupled to an aperture in the toggle arm and a free end movable into an aperture in the lid, and a short locking rod, the lock rods adapted to move between a retracted unlocking orientation and an extended locking orientations coupling the lid to the tub;

a lower locking sub-assembly including a cross bar with a centrally positioned upwardly extending pivot pin extending upwardly through the central leg of the stand, the cross bar located beneath the central leg with downwardly extending fingers, the pivot pin having a washer and a handle above the central leg, and locking bars with apertured interior ends receiving the fingers, the locking bars having free ends movable into apertures in the side legs to lock the legs in a collapsed orientation; and a plurality of shelves, each shelf having a horizontal section below for receiving cooling-related objects, each shelf having a hook shaped end above for removably positioning over a side edge of the tub, each shelf having a vertical section coupling the horizontal section and the hook shaped end.

* * * * *